US009601094B2

(12) United States Patent
Bradfield

(10) Patent No.: US 9,601,094 B2
(45) Date of Patent: Mar. 21, 2017

(54) DRUM STICK HOLDER

(71) Applicant: Graham Bradfield, Tampa, FL (US)

(72) Inventor: Graham Bradfield, Tampa, FL (US)

( * ) Notice: Subject to any disclaimer, the term of this patent is extended or adjusted under 35 U.S.C. 154(b) by 346 days.

(21) Appl. No.: 13/904,495

(22) Filed: May 29, 2013

(65) Prior Publication Data

US 2014/0061413 A1 Mar. 6, 2014

Related U.S. Application Data

(63) Continuation-in-part of application No. 12/915,971, filed on Oct. 29, 2010, now abandoned.

(60) Provisional application No. 61/256,077, filed on Oct. 29, 2009.

(51) Int. Cl.

| | |
|---|---|
| ***G10D 3/00*** | (2006.01) |
| ***G10D 13/00*** | (2006.01) |
| ***G10G 5/00*** | (2006.01) |

(52) U.S. Cl.

CPC ..... *G10D 13/003* (2013.01); *G10G 5/00* (2013.01)

(58) Field of Classification Search

CPC .... G10D 13/003; G10D 13/02; G10D 13/026; G10D 7/00; G10D 5/00

USPC ..... 248/229.1, 300; 84/327, 421, 411 R, 84/422.4, 329; 211/85.6

See application file for complete search history.

(56) References Cited

U.S. PATENT DOCUMENTS

| | | | | |
|---|---|---|---|---|
| 2,099,254 A * | 11/1937 | Ballman | A01K 97/10 224/922 |
| 2,452,116 A * | 10/1948 | Felton | A01K 97/10 248/300 |
| 5,522,300 A * | 6/1996 | Cheatwood | G10D 13/003 206/314 |
| 7,164,074 B1 * | 1/2007 | Graham | G10D 13/003 84/421 |
| 8,878,039 B2 * | 11/2014 | Chambers | G10D 13/003 84/327 |
| 2014/0060285 A1 * | 3/2014 | Bradfield | G10D 13/003 84/411 R |

* cited by examiner

*Primary Examiner* — Todd M Epps

(57) ABSTRACT

A repositionable support system for drum-related objects comprises an upper assembly including a base plate adapted to removably receive drum related objects; a lower assembly including an attachment member adapted to removably couple the lower assembly to a recipient object; and an intermediate assembly separably coupling the upper and lower assemblies.

2 Claims, 20 Drawing Sheets

FIG. 35
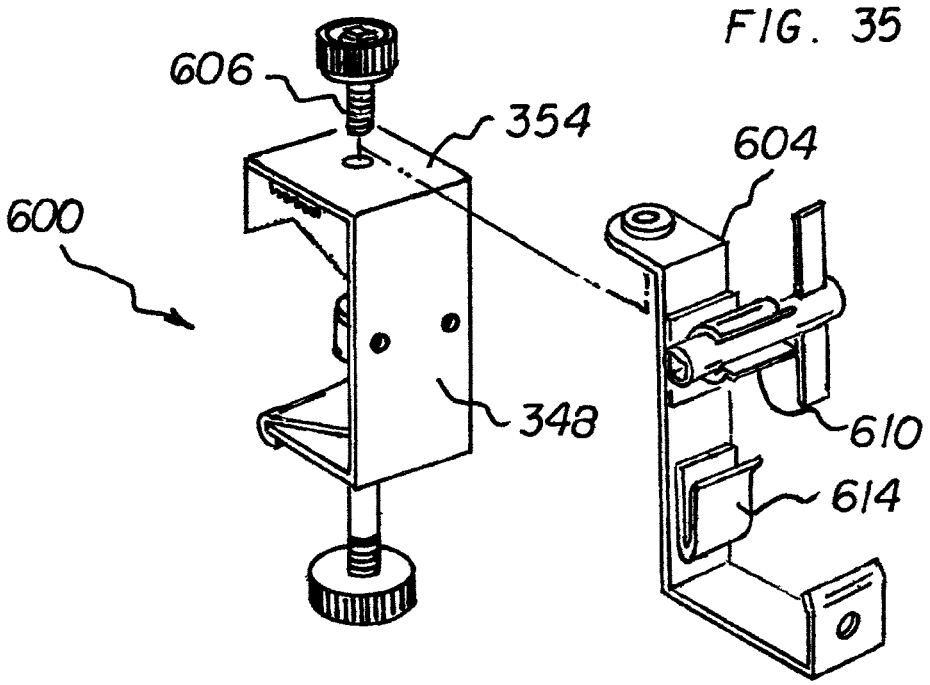
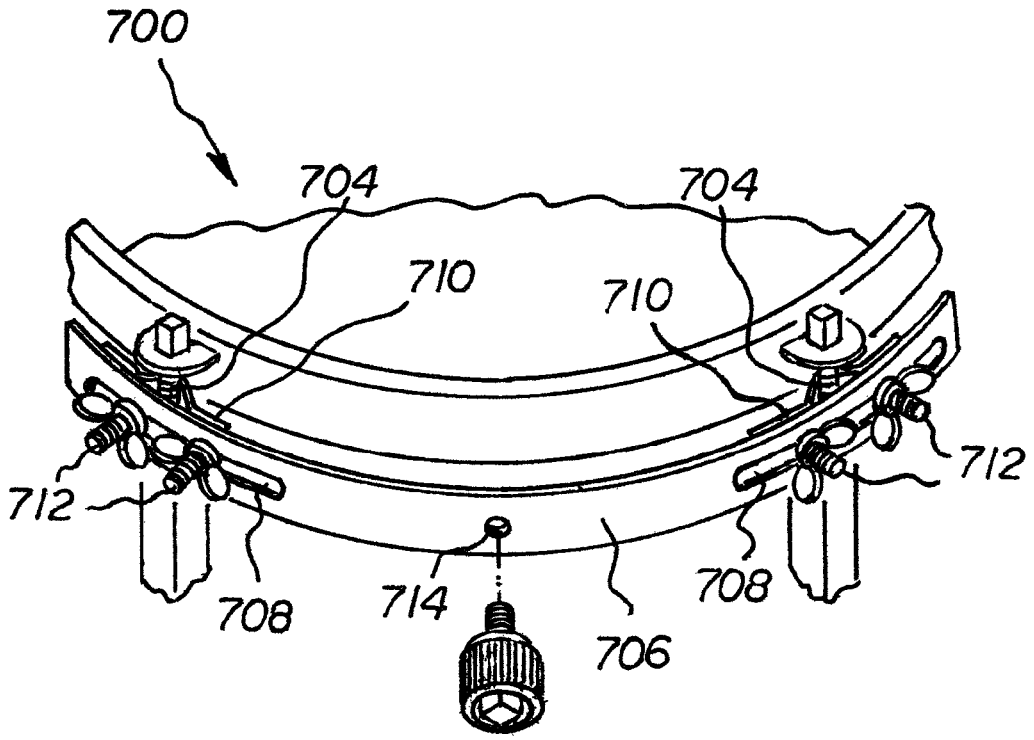
FIG. 36

FIG 37
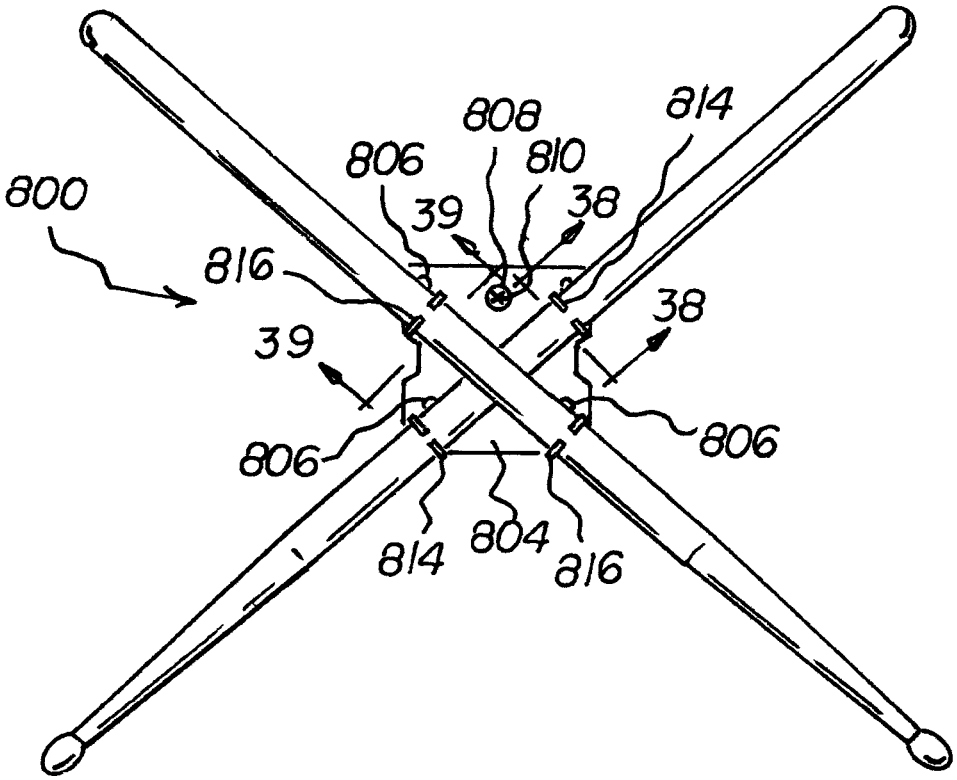
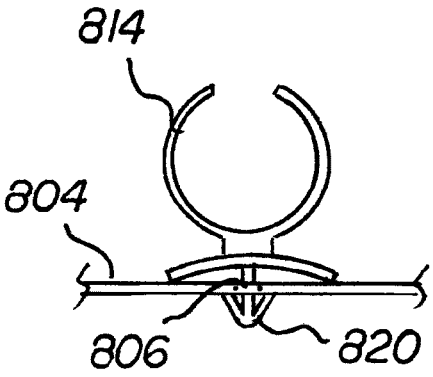
FIG. 38
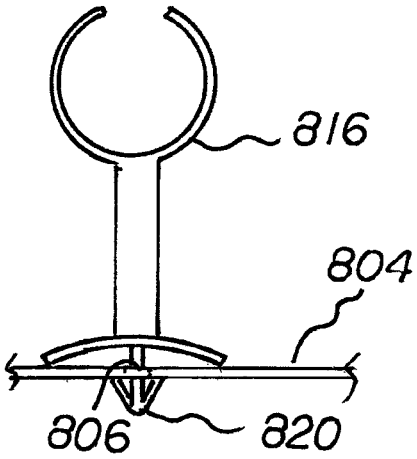
FIG. 39

DRUM STICK HOLDER

CROSS REFERENCE TO RELATED APPLICATIONS

This application is a continuation-in-part of pending application Ser. No. 12/915,971 filed Oct. 29, 2010 entitled "Drum stick Holder" which, in turn, claims the benefit of priority to U.S. Provisional Patent Application 61/256,077, also entitled "Drum Stick Holder," filed Oct. 29, 2009, the contents of which applications are herein incorporated by reference.

FIELD OF INVENTION

This invention relates to musical equipment accessories; more specifically, to a device for holding and storing drum sticks or other similarly-shaped musical accessories.

BACKGROUND OF THE INVENTION

Drummers and other percussionists often need to readily store and retrieve drum sticks. There is often little time in which to change sticks when a drummer is playing. As such, having quick and easy access to the right stick at the right time has a profound effect on a drummer's performance and creative control.

There are different types of drum stick holders currently available, however these drum stick holder designs are inefficient and awkward to use. Most designs focus on using a tube, suspended bag, or pouch-style apparatus. With these designs, a stick must be removed by drawing it out in a consistent primarily upward motion, much like taking a sword from a scabbard. This motion is counter to the natural motions that are used during drum kit playing. Further, these designs do not allow direct and ready access to the sticks by the drummer which is needed for quick transitions.

Many existing drum stick holders use tubes (of metal, plastic, PVC, or cloth) to hold the drum sticks. This design only allows for lengthwise insertion and removal of the drum sticks and makes only one end of the drum stick accessible. Drum sticks also tend to clump together, which can make selection during musical performance difficult, slow, and error prone. In addition, normal playing vibrations cause drum sticks to move around in the holder, which not only makes selection difficult and noisy, but can also cause damage to the sticks and unwanted rattling noise during playing.

Most existing drum stick holders rely solely on gravity to hold sticks in place. In these designs, sticks fall out easily. In addition, they are limited in their placement on or about the drum kit—for practical use, the holder must be below drummer's mid-line. One must also take care not to tilt the holder too far past vertical or the sticks will fall out.

The currently available drum stick holders also suffer from the drawback of being unable to be attached to different multiple points on the drum set. Most existing drum stick holder designs are attached to the drum kit by a clamp that only fits in one type of place and is pre-set to that application only (e.g. tubular stands for drum arrangement, cymbal stands, floor tom legs, or tensioning rod). Thus, a user is unable to position the drum stick holder anywhere else and, in many cases, a user's ideal position is not possible. If additional mounting methods are possible, they usually require additional tools.

As stated above, most existing drum stick holders are limited to attaching one of two broad categories of attachment location/method: either to the generally tubular components of drum and cymbal stands, or to the tensioning rods, which are located around the perimeter of a drum hoop (or rim). However, the user cannot switch between methods. The tensioning rod attachment design used by the currently available drum stick holders requires that a user completely unscrew and pull out, then, insert and re-screw two tensioning rods (first from the original location, then from the new location) to move the drum stick holder to a new location, even if it's on the same drum. The currently available drum stick holders suffer from the drawback that when they are attached to the tensioning rod, the drum(s) then have to be re-tuned. Additionally, this design also acts as a lever between the tensioning rod and the drum hoop which causes undesirable loosening of the drum head under normal playing conditions, thus changing the tone and timbre of a drum due to pressure and vibrations transmitting directly to the hoop and tensioning rod. This loosening or de-tuning, in turn, shortens the lifespan of drum heads, which are costly to replace. De-tuning can also be caused by sticks being added or removed due to changes in weight on the holder which are transmitted directly to the tensioning/tuning rod and hoop via leverage force.

The drum stick holder of the present invention solves the problems associated with the currently available types of drum stick holders and provides drummers new ways to be creative with stick types and make fast changeovers. The present invention presents an improved drum stick holder having a sturdy and durable adjustable attachment system which is capable of holding different sized drum sticks in any position allowing for the fast and easy insertion and removal of drumsticks. The present invention greatly increases diversity in mounting location choices. The design of the present invention manages impact and vibration from the insertion and removal of drum sticks. The easy repositioning of the drum stick holder to any location allows the lifespan of the drum heads to be maintained.

SUMMARY OF THE INVENTION

In an embodiment of the present invention, an adjustable drum stick holder is presented. The drum stick holder is generally comprised of a mounting bracket and a device mounting unit. The mounting bracket is comprised of a main bracket having at least three sides; a bracket pad having a pad mounting surface and a main bracket contact surface and a thumb screw in contact with a mounting surface. The bracket pad is positioned within the main bracket such that the bracket contact surface is mounted to the main bracket on one of the three sides and the pad mounting surface is in contact with a mounting surface. The thumb screw is disposed through an opening on the side of the main bracket opposing the bracket pad.

The device mounting unit can be a post, a support member, or at least one clip. The device mounting unit is disposed on the same one of the three sides as the bracket pad.

The support member is rotatably attached to the mounting bracket and is comprised of a base plate having a first side and a second side; a mounting hole disposed in the base plate; and at least one clip attached to the first side of the base plate. The mounting hole extends from the first side of the base plate to the second side of the base plate and is adapted to accept a mounting device. The mounting device can be a rotation adjustment fastener, a post, or a screw. The support member can be further comprised of at least one clip base to attach at least one clip to the first side of the base plate.

At least one spacer can be positioned between the second side of the base plate and the main bracket on the same one of the three sides as the bracket pad.

A screw tip can be positioned on an end of the thumb-screw. A screw tip pad which is adapted to directly contact the mounting surface can be positioned on the end of the screw tip.

In an embodiment, the drum stick holder can comprise a support member and a mounting bracket. The support member can be comprised of a base plate having a first side and a second side; a mounting hole disposed in the base plate; and at least one clip attached to the first side of the base plate. The mounting hole can extend from the first side of the base plate to the second side of the base plate and is adapted to accept a mounting device. The mounting device can be rotation adjustment fastener, a post, or a screw.

The mounting bracket is attached to the support member and is comprised of a main bracket having at least three sides; a bracket pad having a pad mounting surface and a main bracket contact surface; and a thumb screw. The bracket pad is positioned within the main bracket such that the bracket contact surface is mounted to the main bracket on one of the three sides and the pad mounting surface is in contact with a mounting surface. The thumb screw is disposed through an opening on the side of the main bracket opposing the bracket pad. The thumb screw is in contact with the mounting surface. In this embodiment, the support member is rotatably attached to the same side of the main bracket as the bracket pad.

A post can extend from the same side of the main bracket as the bracket pad. Where the mounting device is a rotation adjustment fastener, the rotation adjustment fastener can attach to the post to rotatably attach the support member to the mounting bracket.

The drum stick holder also can include at least one clip base that is positioned between the first side of the base plate and at least one clip. The clip can be a U-shaped clip.

At least one spacer can be positioned between the second side of the base plate and the main bracket on the same side as the bracket pad.

A screw tip can be positioned on the end of the thumb-screw. A screw tip pad can be positioned on the end of the screw tip. The screw tip pad is adapted to directly contact the mounting surface.

In another embodiment, a support member is presented. The support member is comprised of a base plate having first and second sides; at least one clip attached to the first side of the base plate; and attachment means for attaching the support member to a mounting surface. The support member can further contain at least one clip base to attach at least one clip to the first side of the base plate. The clip can be a U-shaped clip.

BRIEF DESCRIPTION OF THE DRAWINGS

For a fuller understanding of the invention, reference should be made to the following detailed description, taken in connection with the accompanying drawings, in which:

FIG. 35 is an exploded perspective illustration of the upper components of the system of FIGS. 28 and 29 but with the holder being for a drum tuning key and cables and a wide variety of additional items including, but not limited to, towels, shirts, hats and the like with an additional hole for attaching more items such as the drum stick support 314, 316 from FIG. 37 to hold a drum stick or the clip 324 from FIG. 29 to hold sheet music, set lists and the like.

FIG. 36 is an exploded perspective illustration of the upper components of the system of FIGS. 28 and 29 but with the holder being for a thumb screw.

FIG. 37 is a plan view of the upper components of the system of FIGS. 28 and 29 but with the holders being for crossed drum sticks, the holders being rotatable and interchangeable with the clips being of different heights and of different colors, these clips 814 and 816, being rotatable and interchangeable, also provide a means of orientating drum sticks in other ways, such as horizontal, vertical or angled, and of various color combinations.

FIGS. 38 and 39 are cross sectional views taken along lines 38-38 and 39-39 of FIG. 37.

DETAILED DESCRIPTION

Figure 1:
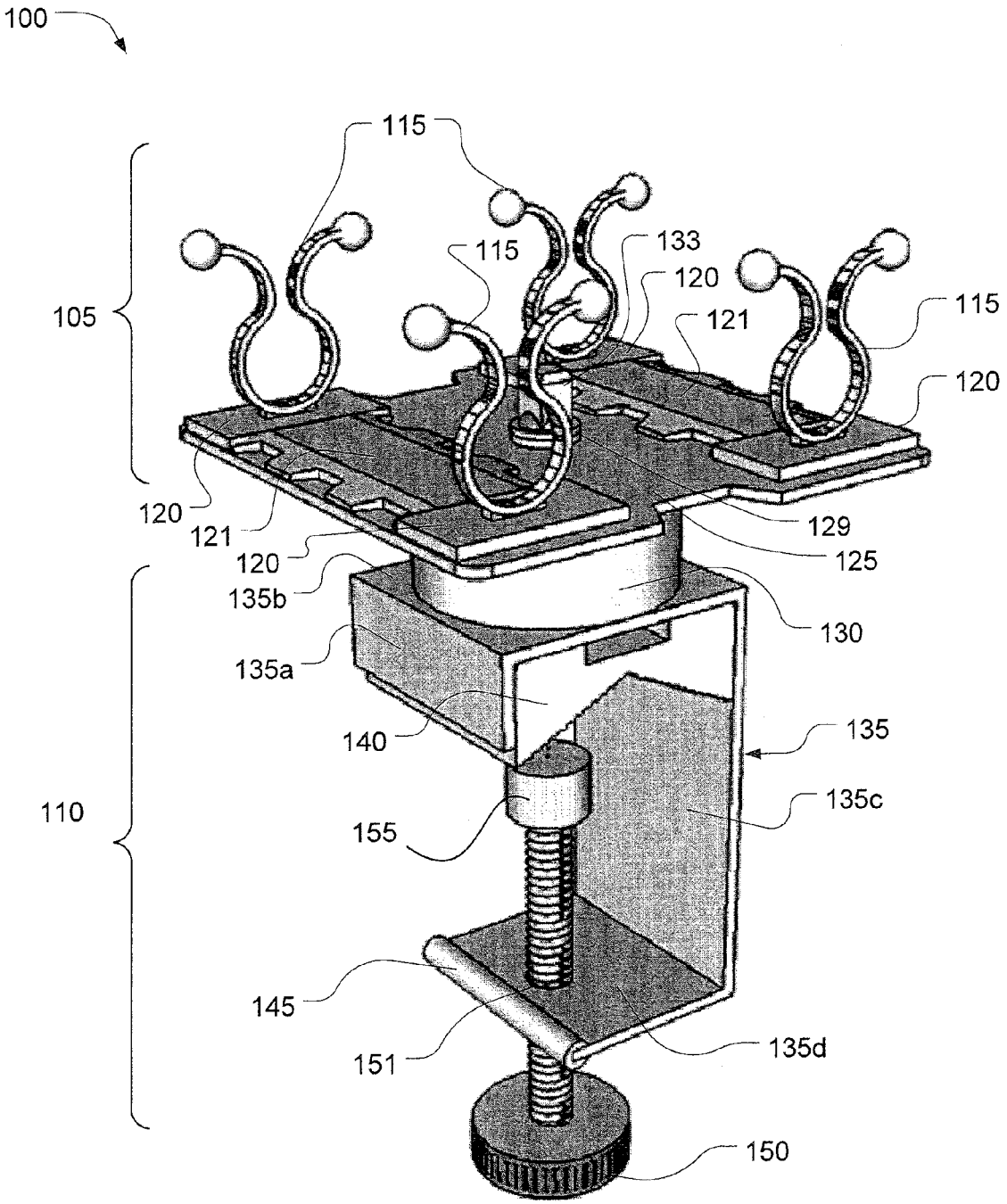
FIG. 1 is a perspective view of the drum stick holder according to an embodiment of the present invention.
Figure 2:
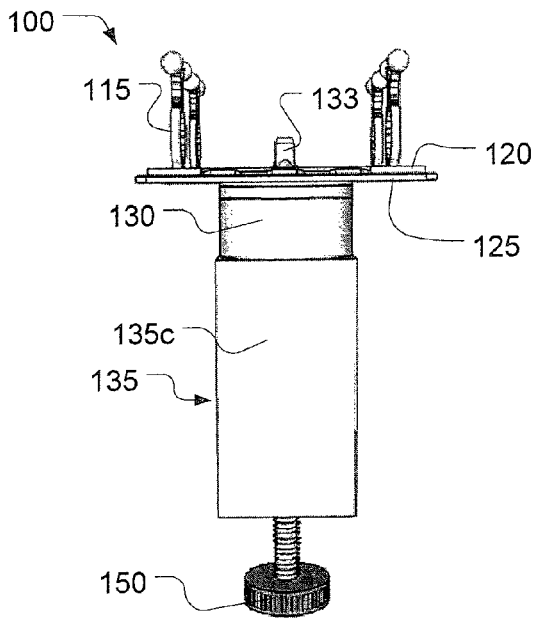
FIG. 2 is a back plan view of the drum stick holder according to an embodiment of the present invention.
Figure 3:
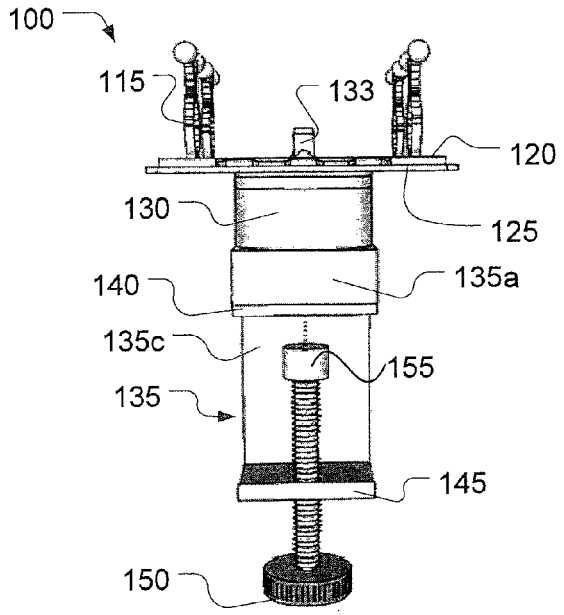
FIG. 3 is a front plan view of the drum stick holder according to an embodiment of the present invention.
Figure 4:
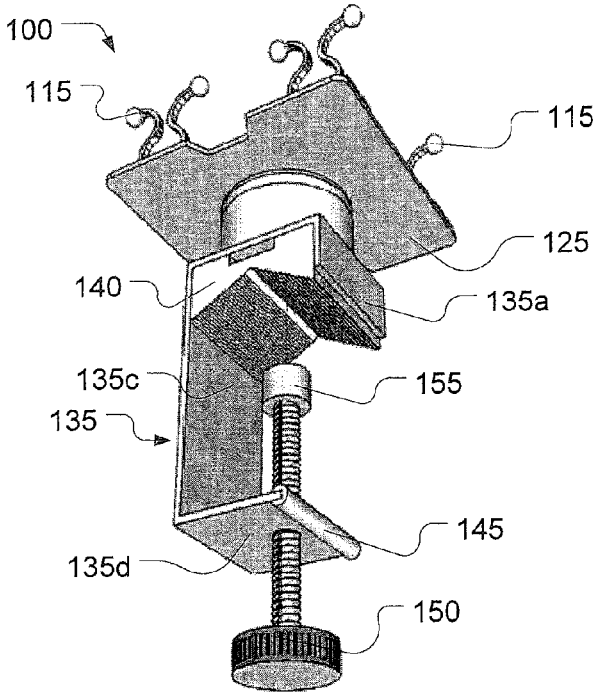
FIG. 4 is a perspective view of the drum stick holder according to an embodiment of the present invention.

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

FIGS. 1 through 4 show an embodiment of drum stick holder 100. Drum stick holder 100 includes support member 105, spacer(s) 130, and mounting bracket 110. Support member 105 includes base plate 125 having clip base(s) 120 affixed thereon. Clips 115 are mounted on clip base 120. Support member 105 is secured to spacer 130 and mounting bracket 110 with post 134 (shown in FIG. 10) and rotation adjustment fastener 133.

Mounting bracket 110 includes main bracket 135 having first side of mounting bracket 135*a*, second side of mounting bracket 135*b*, third side of mounting bracket side 135*c*, and fourth side of mounting bracket 135*d*, thumb screw 150 having screw tip 155 threaded through opening 151 in fourth side of mounting bracket 135*d*. Mounting bracket 110 further includes bracket pad 140 fitted into a C-shaped opening created by first side of mounting bracket 135*a*, second side of mounting bracket 135*b*, and a portion of third side of mounting bracket 135*c*. Tail pad 145 is optionally affixed to an edge of fourth side of mounting bracket 135*d*.

Figure 5:
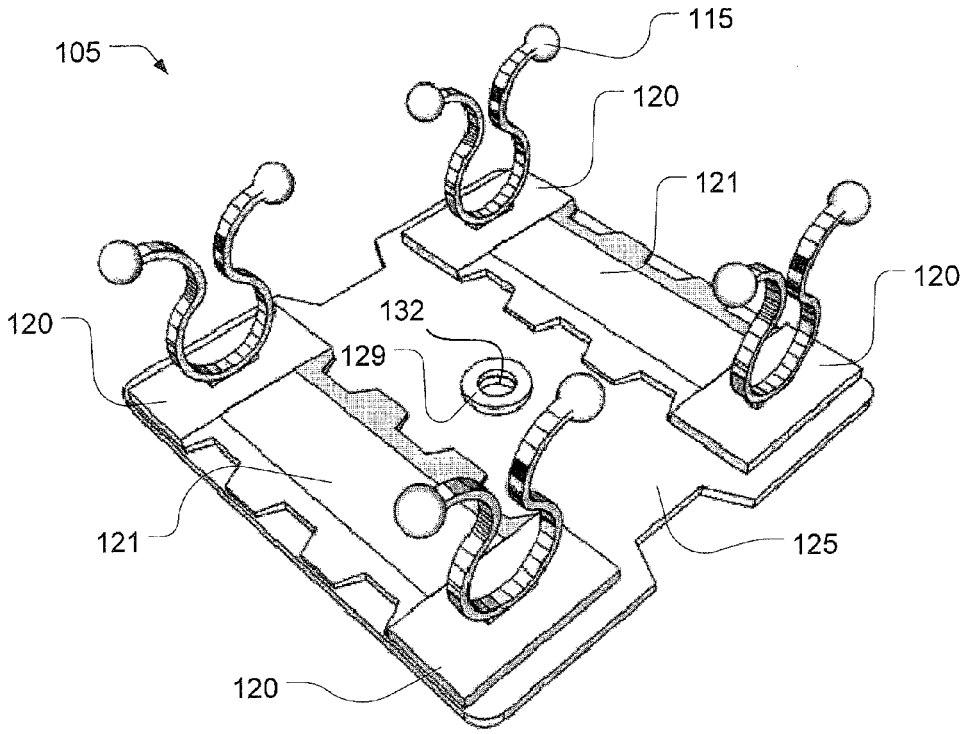
FIG. 5 is a perspective view of the support member of the drum stick holder according to an embodiment of the present invention.
Figure 6:
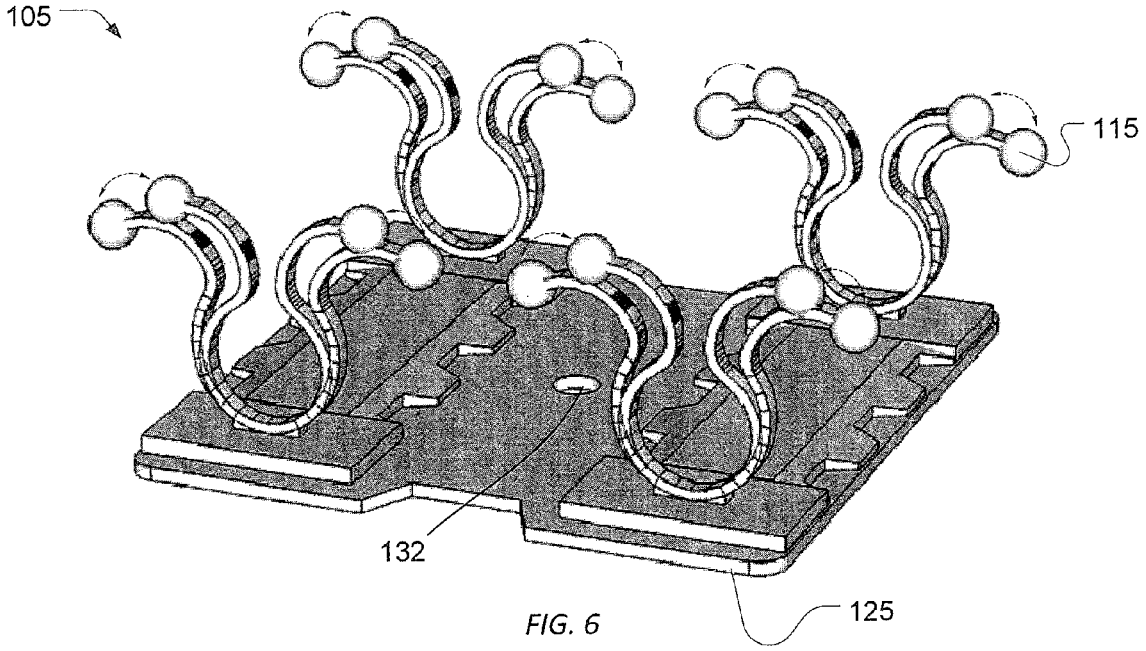
FIG. 6 is a perspective view of the support member of the drum stick holder showing movement of the clips according to an embodiment of the present invention.
Figure 7:
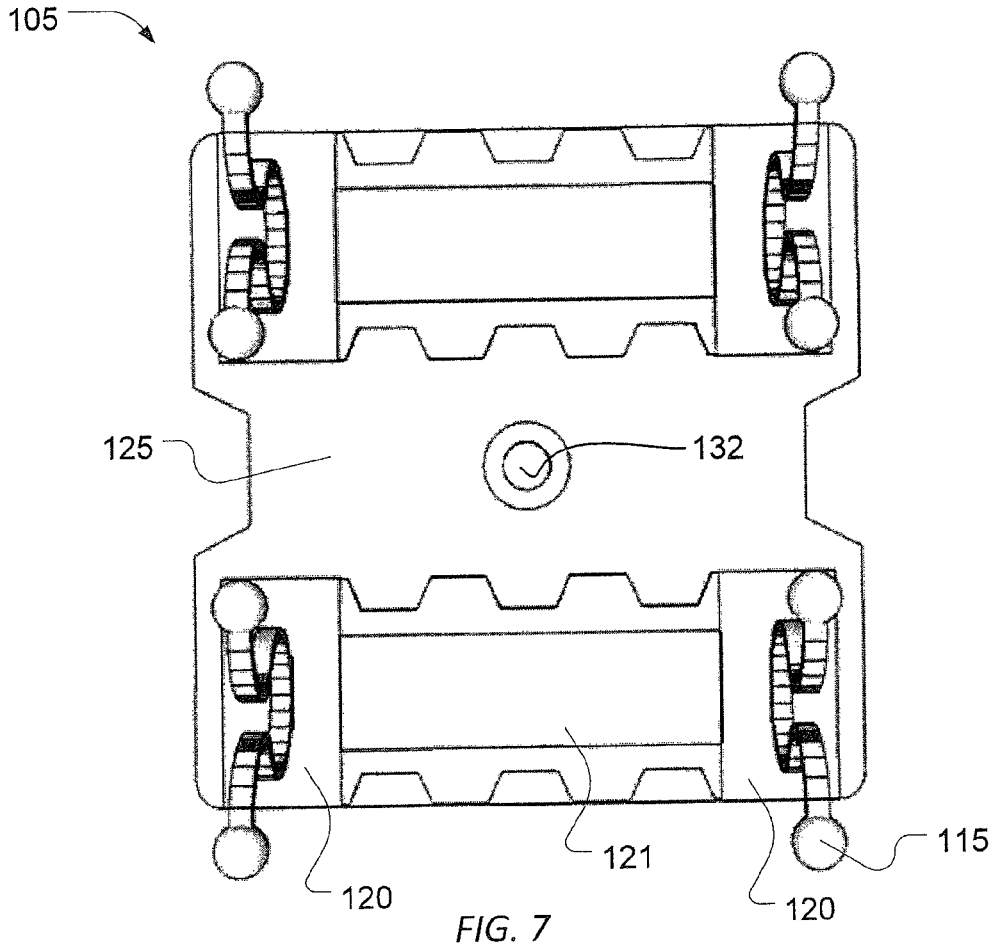
FIG. 7 is a top plan view of the support member of the drum stick holder according to an embodiment of the present invention.
Figure 8:
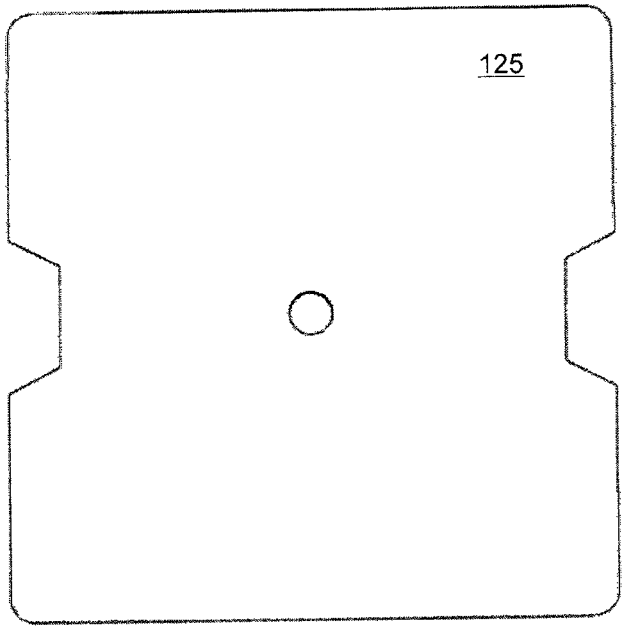
FIG. 8 is a bottom plan view of the base plate of the support member of the drum stick holder according to an embodiment of the present invention.

Support member 105 is further illustrated in FIGS. 5 through 7. In the Figures, base plate 125 is depicted as being substantially rectangular in shape, however base plate 125 may take any shape and size. Base plate 125, as shown in FIG. 8 for example, may take the shape of a square having notches on two edges. Although the notches are optional, if used, they do provide a visual indicator to show the user correct placement of the drum sticks. In addition, base plate 125 may also have decorative cuts, holes, grooves, and the like. Base plate 125 may also be expanded in size to accommodate additional clips. Base plate 125 is preferably constructed of a substantially rigid, lightweight sheet of material such as a metal, hardened rubber or wood. The construction materials disclosed above are for illustrative purposes only and are not to be construed in a limiting sense. The base plate 125 can be manufactured of any material that is rigid enough to support the clips 115, clip bases 120, clip links 121 and the drum sticks held by the clips 115. Support member 105 may be modified to have different shapes, configurations and numbers of clips 115, or a different stick holding method (i.e. different clips).

Figure 26:
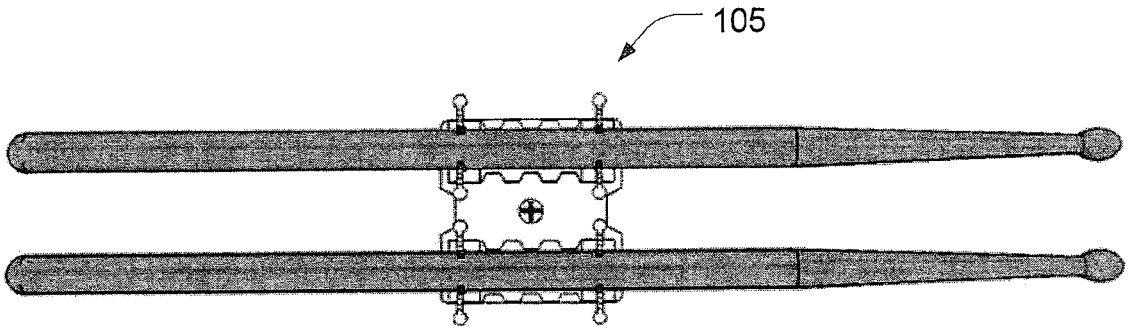
FIG. 26 is a top plan view of the drum stick holder shown with drum sticks mounted in a first arrangement thereon according to an embodiment of the present invention.
Figure 27:
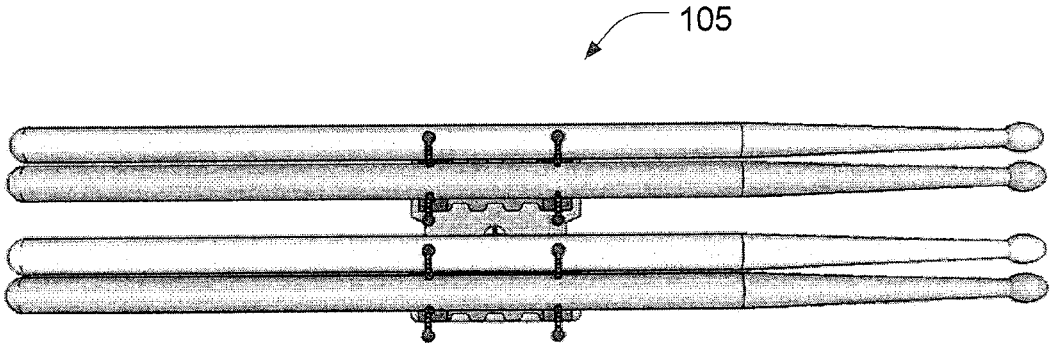
FIG. 27 is a top plan view of the drum stick holder shown with drum sticks mounted in a second arrangement thereon according to an embodiment of the present invention.

Support member 105 may contain any number of clips 115 but must contain at least one clip 115. In the embodiment shown in FIGS. 5 through 7, there are two sets of clips 115. Each set can hold two drumsticks (as illustrated in FIGS. 26-27). The clips 115 can be attached to the support member 105 through the use of clip bases 120 or in the alternative, the clips 115 may be attached to the support member directly by any known attachment means, including but not limited to adhesives, screws, welding, etc. The clips 115 can be positioned on the base plate 125 in any configuration that is conducive to permitting a plurality of drum sticks to be held by the clips 115.

Clips 115 are flexible, durable and instantly and automatically self-adjust to the size of the drum stick. This movement is illustrated in FIG. 6. Such movement and flexibility allows the clips to adapt automatically to fit a number of popular, common stick sizes and many unusual sizes as well. Clips 115 even fit odd and hybrid sizes and those with drastic changes in diameter. The clips 115 provide automatic, instant self-adjusting to create an effortless custom fit for a huge range of different stick sizes and types as well as the different contours along any single stick for an all around perfect fit.

Although any number of clips may be used to secure each drum stick, using a pair of clips allows the two clips to work together to create greater stability without the need for increased thickness and bulk that would be needed to get the same stability from a single clip. Furthermore, the separate clips complement and counterbalance the forces of each other. Each clip acts independently so different areas of the stick can be gripped comfortably even if the different areas of the drum stick have different thicknesses. Each clip adjusts and holds separately at the optimum size.

In an embodiment, as shown in the Figures, the clips 115 can be U-shaped clips having a pair of opposing spaced apart arms that are joined together by a juncture segment at the base of each U-shaped clip. The ends of the opposing spaced apart arms extend outwardly away from the base of the clip 115 to provide an opening into which the drum stick is inserted. Each arm has a curved portion for embracing a drum stick disposed there between. The spaced-apart arms are biased towards each other so that insertion of the drum stick into the clip 115 will cause the arms to spread outwardly with the inward bias being of sufficient magnitude to cause the drum stick to be retained within the curved portions of the arms.

Clips 115 have guide wings which extend from the opposing spaced apart arms, as shown in FIGS. 1 through 7. These guide wings are formed from the extended ends of the opposing spaced apart arms of the clips 115 and curve back outwards to form a winged shape that acts as a funnel to guide sticks down toward the correct location while also opening the inner portion of the clip in correct proportion to the size of the incoming stick in order for the stick to both easily locate into the gripping area and for the clip sides to be opened to provide the correct fit for that particular stick diameter. The wings guide the stick into the holder for easier use, and absorb and channel the momentum of the inserted stick.

Spacing between the opposing, spaced apart arms can vary from the juncture segment of the base of the clip 115 to the guide wings of the clip 115. For example, in an embodiment, the spacing between the opposing spaced-apart arms can increase to from a circular opening adjacent to the base of the clip with the spacing tapering approaching the guide wings. This configuration allows the drum sticks to be held securely by the clips 115 without allowing them to slip out unless expressly removed from the clips 115 by the user. The circular opening should be of sufficient dimension so as to fit at least one drumstick within the circular opening. The circular opening can vary according to size, shape and number of sticks to be held in the clips 115. While one embodiment featuring U-shaped clips is discussed herein, it is to be understood that such disclosure is purely illustrative and is not to be interpreted as limiting. Other types of clips are contemplated for use in the invention as long as the clips are capable of securely holding at least one drum stick and allow for easy removal/insertion of the stick into the clip.

Clips 115 can be manufactured of any resilient material such as a metal, plastic or rubber. For example, spring steel may be used to manufacture the clips. These materials are merely used for illustrative purposes and are not to be considered limiting in any sense. Other materials that are sufficiently durable and slightly flexible are contemplated as being within the scope of the invention. The clips 115 are smooth, flexible, resilient, and made from non-abrasive material, which prevents stick damage and helps to guide a stick in to the correct position. The combination of the shape and material of clips 115 work together as a shock absorber to reduce the impact on a drummers hand when inserting a stick, to prevent damage to the stick itself, and to reduce the effects of vibration from loosening sticks while they sit in holder 100. The shock absorbing quality is further enhanced by clip base 120 and spacer 130.

The clips 115 allow for fast insertion and removal of sticks with little precision. The clips 115 also provide for improved ergonomics because it provides insertion and removal of sticks at natural angles, multiple angles, and manages impact and vibration which prevents rattling. The clips 115 hold sticks securely regardless of their position relative to the ground. The drum stick holder 100 can be turned in any direction and sticks will not fall out. It even works upside down so sticks are available in more places, including above the drum kit, providing for an increase in placement options. Due to the versatility of clips 115, drum stick holder 100 can also be used to hold bows for stringed instruments or any other similarly-shaped musical accessory.

In an embodiment, as shown in FIGS. 5 through 7, clip base 120 is located beneath each clip 115. Optionally, clip base link 121 expands between clip bases 120 of each set of clips 115. Alternatively, two clip bases 120 and clip base link 121 may be a single structure located beneath a set of clips 115 or multiple sets of clips 115. Clip base 120 (and clip base link 121) may take several forms and may provide a number of functions. Clip base 120 (and clip base link 121) may be a flat (two-dimensional) adhesive print or sticker. Alternatively, clip base 120 (and clip base link 121) may be a three-dimensional rubber (PVC rubber, silicone, or similar material), plastic (nylon or similar material) and/or metal. If made of these materials, clip base 120 (and clip base link 121) can be attached to base plate 125 through attachment means such as welding, adhesive, screws, etc. Alternatively, clip base 120 (and clip base link 121) can be incorporated into base plate 125 to be formed as one unit. Clip base 120 (and clip base link 121) may also be used for decorative purposes and have color(s) and/or designs affixed thereon. Clip base 120 (and clip link 121) may also be used to display a product name, a logo, or model information.

Clip base 120 (and clip link 121) can be of any size or shape and serves to provide structural support to clips 115. Clip base 120 (and clip link 121) may also act as a shock absorber and stabilizer for clips 115 by dissipating vibrations passed from clip 115. Clip base 120 (and clip link 121) provides visual cues to the user to more easily find the correct alignment of the drum sticks to the holder clips.

Clip base 120 (and clip link 121), when made out of impact absorbing materials such as nylon, PVC, rubber or silicone, may act to protect the sticks, the drummer, and drum stick holder 100 from damage in the case of either accidental impacts or inaccurate attempts at inserting the stick into clips 115 (such as off angle or misaligned drum stick strokes).

Base plate 125 can contain mounting hole 132 through which rotation adjustment fastener 133 extends to connect with post 134. Post 134 and rotation adjustment fastener 133 are used to secure support member 105 to mounting spacer(s) 130 and mounting bracket 110. In the embodiment shown in FIGS. 1 through 3, rotation adjustment fastener 133 attaches to post 134 (shown in FIG. 10) extending from second side of mounting bracket **135*b* that is inserted through opening 132. Rotation adjustment fastener 133 also serves to control the rotation of support member 105 by changing the amount of pressure exerted downward on spacer 130. Loosening rotation adjustment fastener 133 allows support member 105 to rotate more easily and tightening rotation adjustment fastener 133 adds friction so that more effort is needed to rotate support member 105. When tightened enough, support member 105 becomes stationary and stays in a fixed position. Washer 129 may be located under rotation adjustment fastener 133** to facilitate smooth turning.

Rotation adjustment fastener 133 can be any type of screw head or knob. In an embodiment, rotation adjustment fastener 133 may be a standardized drum tensioning-rod style screw. This type of screw provides added convenience to drummers because it is not only easy to grasp and adjust by hand but can also be adjusted with a common drum key that is carried by most drummers.

In an alternative embodiment, the orientation of the rotation adjustment fastener 133 can be reversed such that the head is positioned inside main bracket 135, concealed under bracket pad 140. The shaft of rotation adjustment fastener 133 would go through opening 136 in main bracket 135 and continue up toward support member 105. In this approach, there is no need for opening 132 of support member 105; instead, a threaded block, disk, or post would be attached (using adhesive, welding or other method) to the underside of support member 105 and have a threaded hole that the shaft of the screw could connect to in order to attach support member 105 to mounting bracket 135. In this case, various different fastener heads could be used (e.g. slotted, Phillips, hex head). This embodiment allows support member 105 to remain unobstructed by openings or voids and provides a completely smooth appearance.

Spacer 130 can be a single spacer or multiple spacers of varying shapes, thickness and materials. Spacer 130 can be slightly taller in height than post 134 to allow for less friction. Spacer 130 should also be of sufficient diameter to keep support member 105 stable so that it does not wobble. This helps hold the drum sticks by reducing movement that may otherwise work to loosen the grip of clip 115 on the drum sticks. In an embodiment, spacer 130, as shown in FIGS. 1 through 4, is a single cylindrical spacer. Spacer 130 can be manufactured from a rubber material; however, any appropriate material is contemplated, including, but not limited to plastic, nylon, wood, or metal. Spacer 130 is positioned between support member 105 and mounting bracket 110 and can contain a void in the center to allow post 134, (shown in FIG. 10) to extend from mounting bracket 110 through spacer 130 to support member 105. Spacer 130 works to provide tension between the mounting bracket 110 and the support member 105. Spacers 130 having alternative density and materials offer different amounts of shock/vibration absorption. Additionally, alternate density and materials modify the rotation characteristics (e.g. smoother and easier rotation or stiffer and slower rotation). In another embodiment, spacer 130 and the connection between mounting bracket 110 and support member 105 may be replaced by a ball & socket style design.

As stated previously, spacer 130 may also include one or more expansion spacers, which can be used to add height to support member 105 by increasing the distance between support member 105 and bracket 110. Expansion spacers may be of any shape, thickness or manufactured of any materials known to those of ordinary skill in the art. In an embodiment, expansion spacers may be a continuous circle similar to spacer 130 shown in FIGS. 1 through 4. Expansion spacers may also be split disks. The term "split disk" is defined as a spacer having a cut (or split) from the center of the spacer to the outside of the spacer which allows them to be added and removed without removal of support member 105 since the split or cut allows them to slide past rotation adjustment fastener 133 and post 134 (shown in FIG. 10). The "split disk" spacer can be solid throughout except for the cut or split in the spacer.

If rubber alone is used for spacer 130, such material may cause too much friction against the underside of support member 105 and may prevent smooth rotation of support member 105. To remedy this effect, one or more slip disks may be added between support member 105 and spacer 130. A "slip disk" is defined as a thin disk that is made of an appropriate slippery material, such as nylon, which is positioned above or below the spacer to facilitate movement for smooth rotation. In an embodiment, nylon slip disks were used to provide a more consistent amount of slip to reduce friction which allows top-support member 105 to rotate smoothly; however, any suitable material may be used for the slip disks.

Spacer 130 functions to maintain tension against the underside of the top-support member which prevents support member from turning too freely and, at the same time, allows support member 105 to 'float' and move downward independently toward mounting bracket 135 enough to give it impact absorbing characteristics and to be lowered closer to mounting bracket 110, if needed. This tension also acts like a lock washer to keep rotation adjustment fastener 133 from turning once it is set in place. Spacer 130 also protects the mechanical connection (i.e. post 134) between mounting bracket 110 and support member 105 from damage due to impact from errant projectiles (i.e. drum sticks).

Washer 129 made of nylon (or similar material) may be positioned between base plate 125 and rotation adjustment fastener 133 to enhance vibration absorption. Multiple layers of complementary materials of spacer 130 can also be used to absorb and dissipate vibrations and shock that may come from either support member 105 or mounting bracket 110. In an embodiment, spacer 130 is a thick cylindrical rubber spacer with a top surface made of nylon. A cylindrical nylon spacer of reduced thickness placed on top of the nylon-capped rubber spacer. In another embodiment, spacer 130 is a thick cylindrical rubber spacer with two cylindrical nylon spacers of reduced thickness placed on top of the rubber spacer. In both of these embodiments, additional nylon spacers of varying thicknesses can be added above or below the rubber spacer. These embodiments are presented as illustrative and are not meant to be limiting in any way. Additional embodiments for the spacer 130 can readily be ascertained and any modifications or alterations are intended to be encompassed as falling within the spirit and scope of the invention.

Drum stick holder 100 is capable of being positioned close to stand connectors while still allowing support member 105 to be rotated over the connector (or joint) of many common types of drum stands as well as various other brackets that can be found on drum hardware including clamps and other joint attachments. Spacer 130 plays the primary role in making this possible through its height adjustment ability, its ability to enhance stability of top-support member 105 and its ability to facilitate the rotation of top-support member 105 via slip disk. It can easily be modified with the simple addition of expansion spacers to provide even more clearance.

Mounting bracket 110 is shown in FIGS. 9 through 14. As briefly described above, mounting bracket 110 includes main bracket 135 having first side of mounting bracket 135*a*, second side of mounting bracket 135*b*, third side of mounting bracket 135*c*, and fourth side of mounting bracket 135*d*; thumb screw 150; bracket pad 140; and tail pad 145. Thumb screw 150 has screw tip 155 which is threaded through circular opening 151 in fourth side of mounting bracket 135*d*. Bracket pad 140 is fitted into a C-shaped opening created by first side of mounting bracket side 135*a*, second side of mounting bracket 135*b*, and a portion of third side of mounting bracket 135*c*. Tail pad 145 is affixed to an edge of fourth side of mounting bracket 135*d*.

In an embodiment, mounting bracket 110 has the general shape of a "C". In the "C" shaped embodiment, the bracket pad 140 can be positioned against the second side of mounting bracket 135*b* and attached via attachment means known in the art such as welding, screws, nails, adhesives, etc. In an alternative embodiment, mounting bracket 110 has the general shape of an upside down "G" due to first side of mounting bracket 135*a*, which may bend up and inward towards second side of mounting bracket 135*b* creating a lip with an angle of just less than 90 degrees between the two sides. This lip ensures that bracket pad 140 stays in place without the need to add any extra parts or any adhesive. A combination of pressure and friction hold bracket pad 140 securely in place.

Main bracket 135 can be manufactured from any rigid, sturdy, durable material such as a metal, hardened rubber, hardened plastic, wood, etc. In an embodiment, the main bracket is manufactured of steel; however any material of similar function may be used.

Figure 10:
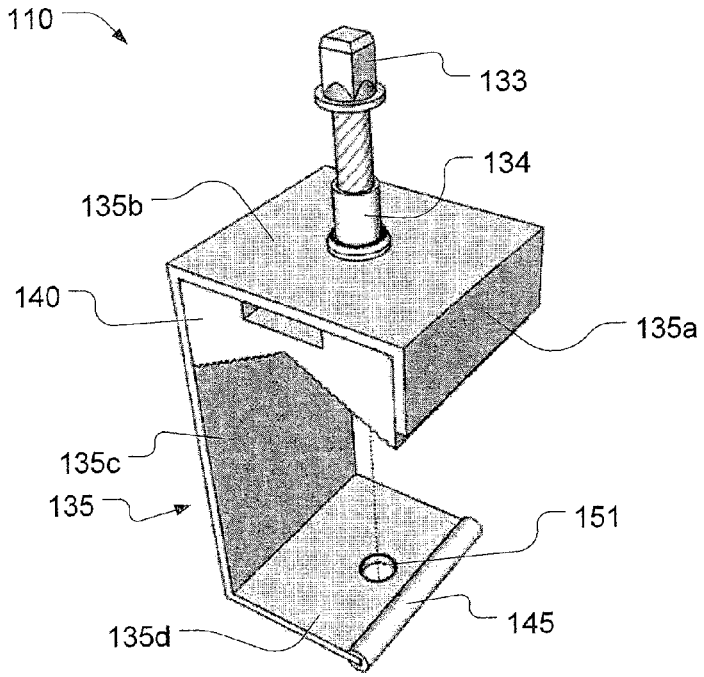
FIG. 10 is a perspective view of the mounting bracket of the drum stick holder with the thumb screw removed according to an embodiment of the present invention.
Figure 11:
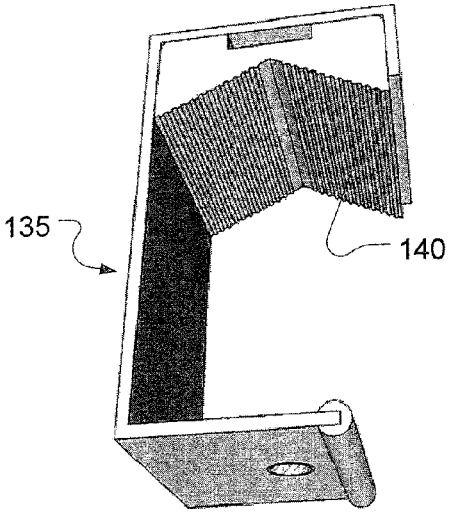
FIGS. 11 and 12 are two views of the mounting bracket of the drum stick holder showing the bracket pad in a first arrangement according to an embodiment of the present invention.
Figure 12:
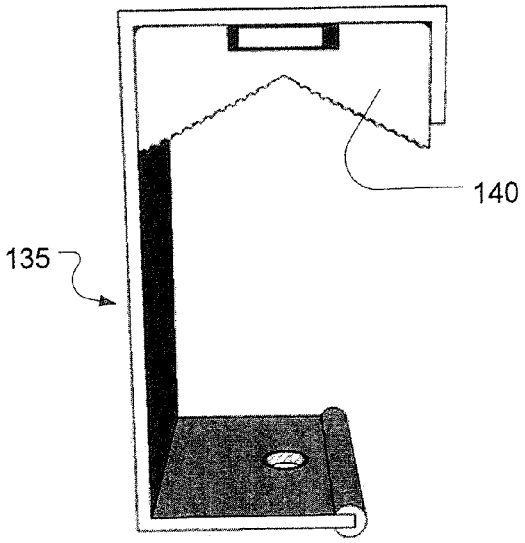
Figure 13:
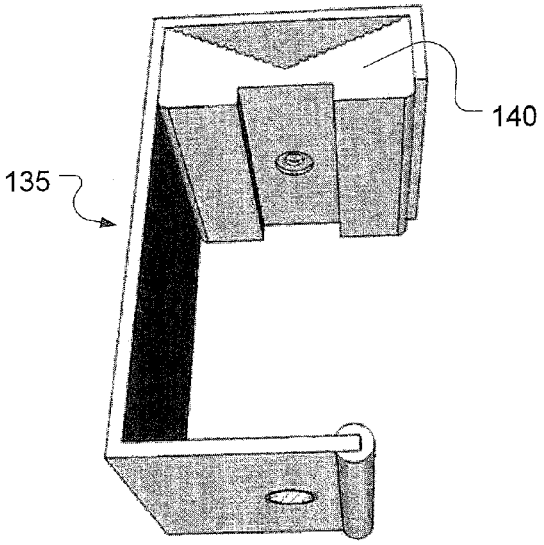
FIGS. 13 and 14 are two views of the mounting bracket of the drum stick holder showing the bracket pad in a second arrangement according to an embodiment of the present invention.
Figure 14:
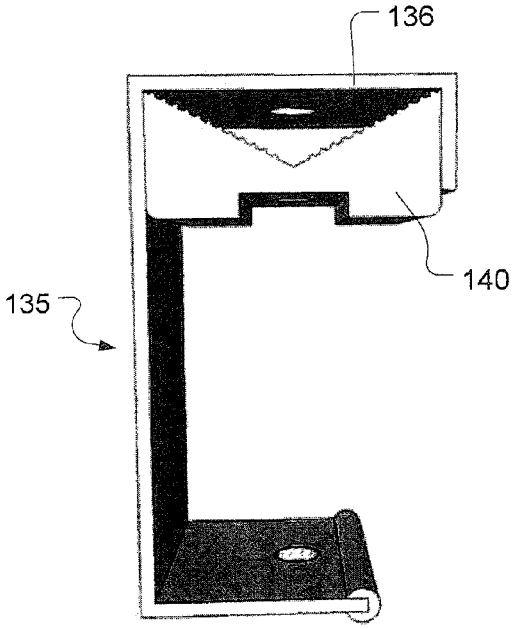

In an embodiment, main bracket 135 has two circular openings—mounting hole 136 on second side of mounting bracket 135*b* (shown in FIG. 14) and circular opening 151 on fourth side of mounting bracket 135*d* (shown in FIG. 10). Mounting hole 136 and circular opening 151 may be aligned. Mounting hole 136 receives post 134. Circular opening 151 is threaded and receives thumb screw 150. In an alternative embodiment, a pressure activated resistance or hydraulic design may replace thumb screw 150.

Thumb screw 150 includes screw tip 155 which makes contact with the mounting location. Screw tip 155 should be of sufficient dimension to provide sturdy placement of the mounting bracket on the mounting location. Screw tip 155 may be manufactured in various sizes, of various materials or combinations of materials and in various colors. Illustrative materials that can be used to manufacture screw tip 155 include the following: a combination of high density rubber having a nylon reinforced core; nylon plastic (6/6 type); nylon with an ultra-silicone core featuring high-pressure tolerant, fast recovery silicone; medium density rubber having a single nylon insert; multiple rubber densities; slotted end solid nylon; wooden tips having printed or carved designs on the outer barrel; or a thin rubber enhanced with a nylon (or another similar material) insert that allows it to turn more freely from a screw's thread.

The embodiment using the combination of high density rubber having a nylon reinforced core has the advantage of the nylon core allowing the screw to rotate inside the tip without tearing at the rubber. Dual nylon inserts provide improved reinforcement, durability & greater adjustment options—the dual nylon inserts slip between each other for smoother tightening. The embodiment using nylon with an ultra-silicone core works best on mounting surfaces besides drum hoops. The all-purpose and slotted nylon tips are preferred on drum hoop mounting surfaces. The embodiment using medium density rubber with a single nylon layer insert is less expensive but not extremely durable. The embodiment using multiple rubber densities provides greater options for vibration dampening but is less durable. The embodiment using slotted end solid nylon works well to hold onto the underside of a drum hoop edge and is optimized for long term installations and extreme conditions. These materials are presented as illustrative and are not meant to be construed in a limiting sense.

Figure 9A:
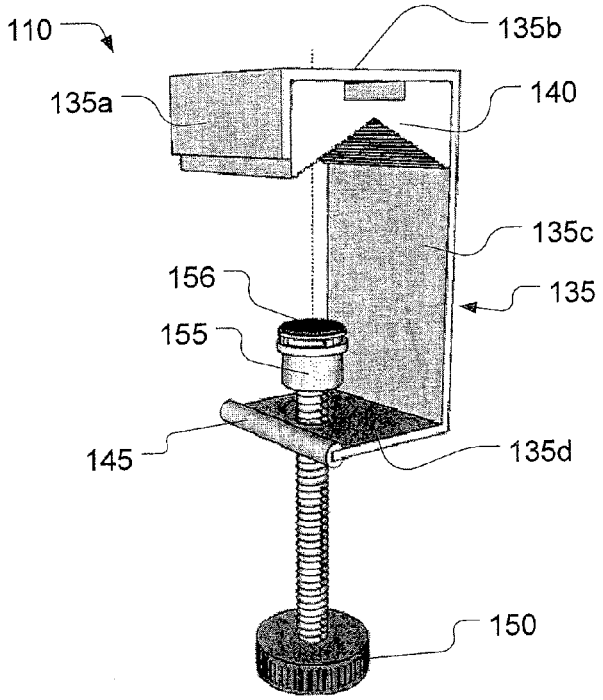
FIGS. 9A and 9B are a perspective view and a front elevational view of the mounting bracket of the drum stick holder according to an embodiment of the present invention.
Figure 9B:
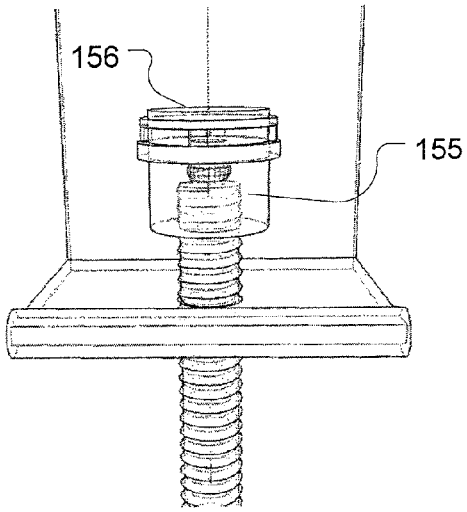

In alternative embodiments, screw tip 155 may optionally by covered by screw tip pad 156, shown in FIGS. 9A and 9B, which further protects the mounting location from thumb screw 150 and enhances the gripping surface. Screw tip pads 156 can be manufactured in different materials, sizes, and configurations for different purposes (including decorative colors to match a drum kit).

Generally, the screw tip 155 can be comprised of a tip having body and head segments, topped off by a cover/"hat" which refers to the screw tip pad 156, as illustrated in FIG. 9B. The body and head segments can be made from a combination of materials such as plastic and nylon, with the screw tip pad 156 comprised of a pad of rubber/silicone type material, covering the outer end. The screw tip pad 156 covers an indentation in the head segment which serves to add stability and enhance the connection to the screw tip pad 156. The body and head segments can be connected together using a ball & socket joint in the midline in addition to an outer fin & groove. These connections increase separation from the screw while allowing for a better grip, better durability, and better attachment to uneven or slanted surfaces. This embodiment also provides both swivel and pivoting.

In another embodiment, a swivel and pivot mechanism can be used. The screw tip may be made of nylon (or similar material) and attaches securely to screw end. The screw tip has swivel and pivot mechanisms built in, particularly both ball and socket and an axle with a wheel element. The screw tip also would contain a defined area to accommodate and reinforce a rubber screw tip pad.

Specifically, screw tip 155 can be comprised of a primary tip cover which can be a hollow tube/cylinder with a thread on its inside surface matching the thread of the screw. This cylinder can be made of any resilient material or combination thereof such as nylon and plastic. The primary tip cover is sufficient alone to provide both an improved hold onto surfaces, due to its wider surface area at the end, as well as protection of surfaces from scratches and other damage that a bare thumbscrew end would inflict.

The primary tip cover may be threaded to provide both easy assembly and subsequent adjustment by the user to add or reduce the length of the thumbscrew, thus increasing variability and range of attachment options. The primary tip cover can function to hold a torque manager and friction channeling disc in place.

The torque manager and friction channeling disc, otherwise known as the TMFC-disc, is a rotatably attached disc having a main disc shaped body that is positioned parallel to and in contact with the flat top surface of the primary tip cover. The TMFC-disc also has a narrow central elongated stem having a wide retainer bulb positioned at its far end. This retainer bulb can extend down into a cavity inside the primary tip cover where it expands and holds secure while allowing it to rotate freely using the stem as a central axle. The TMFC-disc functions to prevent the rotational torque typically produced by a turned thumbscrew upon coming in contact with a surface. The disc also protects from an undesirable sideways movement in the direction of the rotation (commonly referred to as "walk"), which would tend to pull the bracket away from the originally intended point of contact and out of the intended/desired ideal position. This "walk" is especially problematic on cylindrical/tube type mounting surfaces such as those commonly found in abundance on drum kits (such as cymbal stands, drum stands, cymbal boom arms, drum throne posts, etc.). The TMFC-disc also acts as an additional barrier, in connection with the primary tip cover, to prevent marking or damage to the mounting surface that would otherwise be caused by a rotating thumbscrew, or to slight marks that may be caused by the primary tip cover. In effect the TMFC-disc can enhance the protective properties of the primary tip cover.

The primary tip cover and TMFC-disc can be manufactured from complementary materials that allow a smooth interaction between the pieces. Suitable materials include, but are not limited to, nylon such as nylon 6/6, Delrin, and Nylatron, as well as other combinations of materials.

The TFMC-disc provides a slightly recessed cavity/indented top surface area to receive, position and retain a tip friction pad. The TFMC-disc holds the tip friction pad in place and channels the force of friction it produces along its central stem and down into the most stable center area of the primary tip cover, resulting in smoother operation and a more secure hold.

The tip friction pad is a thin soft cylindrical disk which is securely attached to the outer/top surface of the TMFC-Disc.

The tip friction pad can be attached in a slight recess encircled by a "retaining wall" that is slightly lower than the average thickness of the tip friction pad under pressure/compressed. The tip friction pad can be manufactured of a flexible material including, but not limited to, polyurethane, a soft rubber and a foam type material. The tip friction pad contains a semi-tacky surface which functions to improve the grip on the mounting surface. Since the tip friction pad is attached to the TMFC-disc, which rotates freely from the thumbscrew, the tip friction pad can stay in positive contact with the mounting surface. The tip friction pad cannot be twisted in an undesirable way which would result in damage to the mounting surface or to the tip friction pad during either tightening or loosening of the thumbscrew.

The tip friction pad and TMFC-disc function together to produce improved hold while simultaneously preventing undesirable sideways pull during tightening the thumbscrew and marking/damage to the mounting surface. The tip friction pad also functions to absorb some vibration and thus reduces vibration which would otherwise be transmitted from the mounting surface into the bracket.

Mounting bracket 135 can include tail pad 145. Tail pad 145, as shown in FIGS. 9 through 14, is located on the edge of fourth side of mounting bracket 135*d*. The tail pad 145 is positioned along the tail edge of fourth side of mounting bracket 135*d* and parallel to the first side of mounting bracket 135*a*. The tail edge of fourth side of mounting bracket 135*d* is defined as the edge opposite the edge that connects fourth side of mounting bracket 135*d* to third side of mounting bracket 135*c*. Tail pad 145 protects from marks, noise, and vibration and may not be necessary if tail edge of fourth side of mounting bracket 135*d* is smooth. Tail pad can be a raised and/or rounded area extending from one end of the tail edge to the other end of the tail edge of fourth side of mounting bracket 135*d*. The length and proportions of the tail edge combined with tail pad 145 keep mounting bracket 110 positioned parallel to a drum shell or the like. Tail pad 145 also functions to keep the knob of thumb screw 150 away from the drum shell so that it can be turned easily and will not mark the drum shell.

Additional protection from abrasion to the drum shell and from transmission of vibration (in both directions) provided by tail pad 145 is achieved by adding a layer of padding material along the tail edge of fourth side of mounting bracket 135*d*. For example, the tail edge can be coated with a rubberized material or a small u-channel of plastic, rubber or similar material, that wraps around and grips (by physical pressure or adhesive means) onto the tail edge can be used.

In an embodiment, as illustrated in FIGS. 11 through 14, bracket pad 140 has a V-shaped surface with fine grooves that act as grip ridges on one side. This V-shaped surface has a slightly flatter surface at the center portion of the V-shape formed by the two walls of the V-shaped bracket pad 140 as opposed to the two walls forming a true point as is traditionally shown in a V-shape. This flatter center portion allows for greater strength and durability of the bracket pad 140. The V-shaped side is optimized for cylindrical/tubular mounting surfaces of greatly varying size range, such as those commonly found in abundance on drum kits (such as cymbal stands, drum stands, cymbal boom arms, drum throne posts, etc.). The V-shaped side of the bracket pad is positioned to face the screw tip 155. In use, the V-shaped side of the bracket pad 140 is positioned adjacent to the mounting surface. The screw tip 155 is positioned on the opposing side of mounting surface and tightened to attach the mounting bracket 110 to the mounting surface.

The opposite side of the bracket pad 140 is substantially "C-shaped". This C-shaped side has a flatter surface with a large center channel and gentle rounded outer edges on other side. The center channel contains ridges/protuberances to improve the grip and stability of the position choices for the bracket pad 140. The ridges/protuberances also function to create additional repeatable positioning choices. The large center channel can be optionally filled with a softer material insert with fins for extra surface matching contours. The flat surfaces of the C-shaped side of bracket pad 140 are in direct contact with second side of mounting bracket 135*b*. Generally in use, the bracket pad 140 fits snugly within mounting bracket 110 so that the C-shaped side is in direct contact with second side of mounting bracket 135*b*; one end of bracket pad 140 is in direct contact with first side of mounting bracket 135*a*; the opposite end of bracket pad 140 is in direct contact with third side of mounting bracket 135*c*; and the V-shaped side of bracket pad 140 is in direct contact with mounting surface. The C-shaped side of the bracket pad is optimized for holding onto drum hoops/rims (such as those found on snare drums and tom drums), and hoops of the type typically found on bass drums, in addition to any generally flat surface (such as; edge of the top portion of a sheet music stand, any table or desk edge, drum hardware with legs that are square or rectangular in nature). This combination of easily selectable diverse surfaces provides a wide range of mounting options [more than any other drum stick holder], all while having the added benefits of being simple to produce, simple to assemble and simple to operate. A user simply removes, flips and re-inserts the bracket pad 140 to match their desired mounting location.

In an alternative embodiment, bracket pad 140 can be positioned in a reverse orientation to conform to the shape needed to firmly grip a mounting surface.

Bracket pad 140 can be manufactured of a resilient and sturdy material or combination of materials such as a metal, hardened rubber, hardened plastic, nylon, wood, etc. The bracket pad is preferably a rubber material and is securely held in place by a slight compression of the sides of the bracket that surround it. However, it is still easy to remove, flip and then re-insert.

The grooves/ridges/protuberances of bracket pad 140 can be of any dimension and thickness. As an illustration, in an embodiment, the grip ridges of the V-shaped side are approximately 0.03" wide and approximately 0.02" high with 12 grip ridges on each wall of the V-shaped side. As a further illustration, in an embodiment, the ridges of the center channel on the C-shaped side are approximately 0.06" wide and 0.13" high. In this embodiment, the channel itself is approximately 0.6" wide. Multiple textures having finer or thicker ridges/protuberances into the central channel of the C-shaped side of bracket pad 140 or directly into the underside of bracket pad 140 are contemplated. Bracket pad 140 can be constructed as a single unit or can be multiple units. Bracket pad 140 may be fixedly attached to mounting bracket 110 through any known attachment means such as welding, screws, nails, adhesives, etc. In other embodiments, bracket pad may be removably attached to mounting bracket 110 to allow the addition or removal of bracket pad 140 as an interchangeable system.

The combination of tail pad 145, bracket pad 140, and screw tip 155 (or screw tip pad 156) creates a multi-point padded grip system. Together these elements create three or four points of contact, depending on the surface. These elements provide added stability and shock absorption. In addition, a number of other features of drum stick holder 100, including spacer 130 located between support member 105 and mounting bracket 110, work together to absorb and reduce shock of stick impact during insertion, allowing for fast, high force insertion during active drumming.

Figure 15:
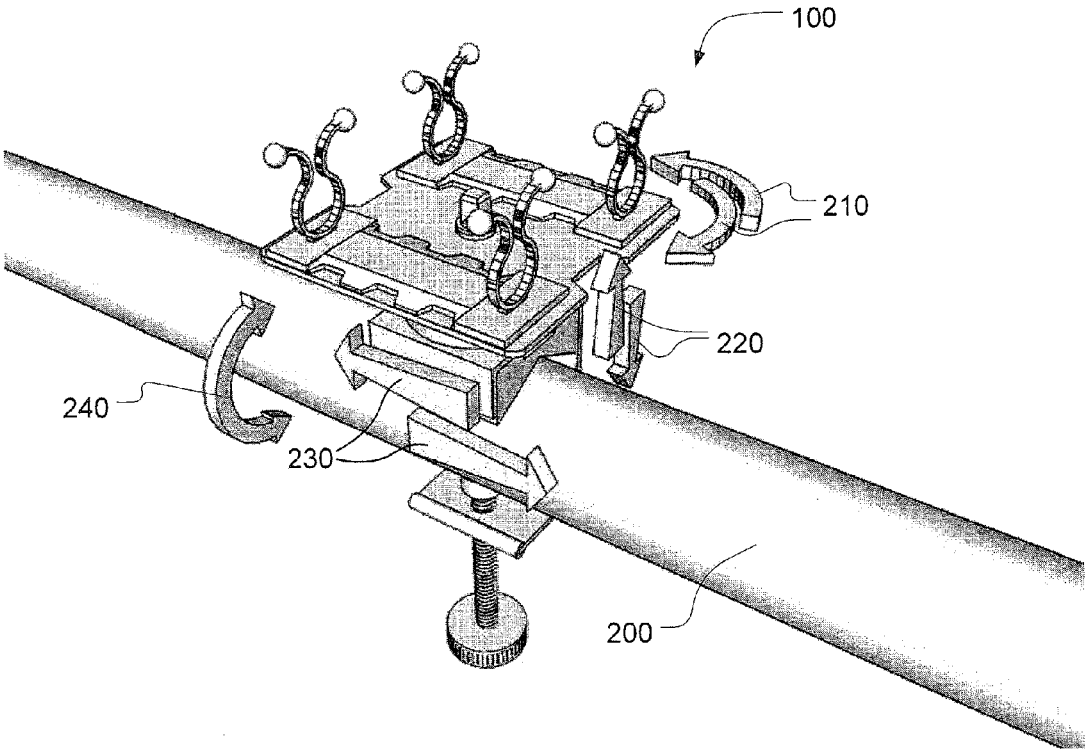
FIG. 15 is a perspective view of the drum stick holder shown mounted to a circular bar and illustrating the movement ability of the device along a number of axes according to an embodiment of the present invention.

Rotation of drum stick holder 100 is illustrated in FIG. 15. Arrows 210 show the direction support member 105 can rotate in relation to mounting bracket 110. Arrows 220 show the directions support member 105 can be raised and lowered in relation to mounting bracket 110. Arrows 230 show the directions drum stick holder 100 can slide back and forth on mounting surface 200. Arrow 240 shows the directions drum stick holder 100 can tilt in relation to mounting surface 200.

Figure 16:
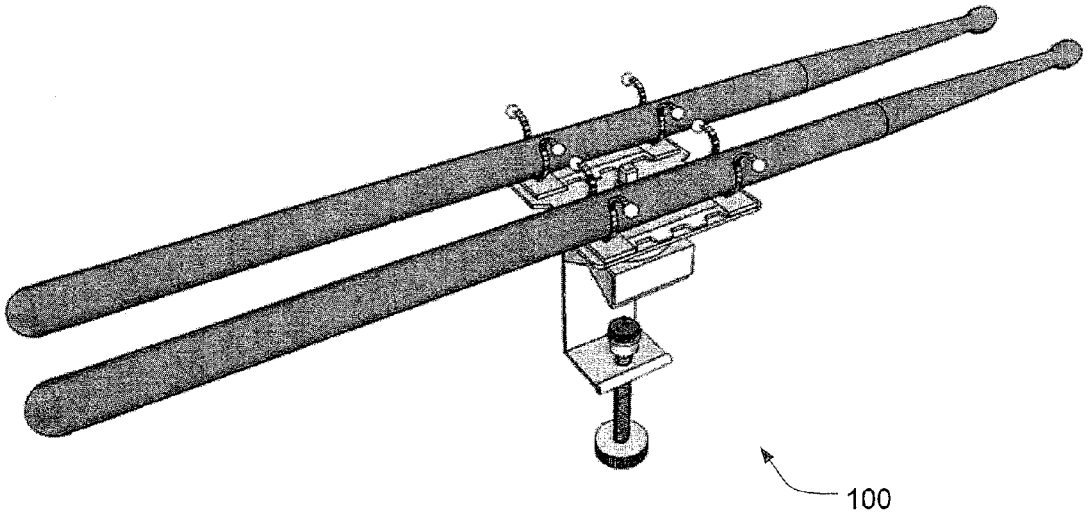
FIG. 16 is perspective view of the drum stick holder shown with drum sticks mounted in a first arrangement thereon according to an embodiment of the present invention.
Figure 17:
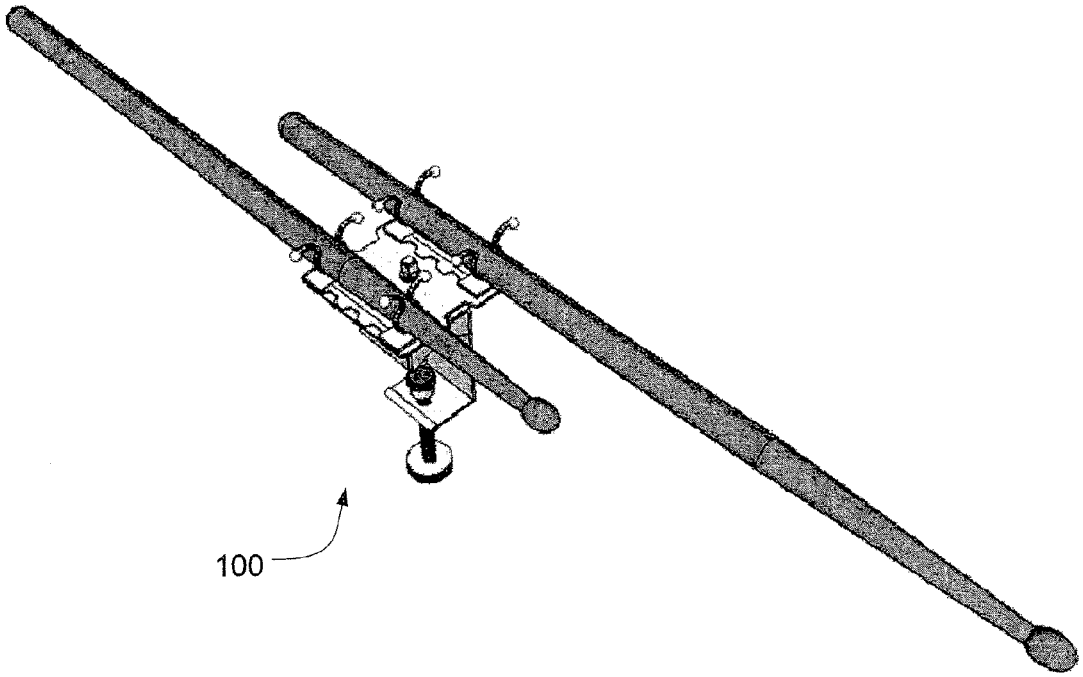
FIG. 17 is perspective view of the drum stick holder shown with drum sticks mounted in a second arrangement thereon according to an embodiment of the present invention.
Figure 18:
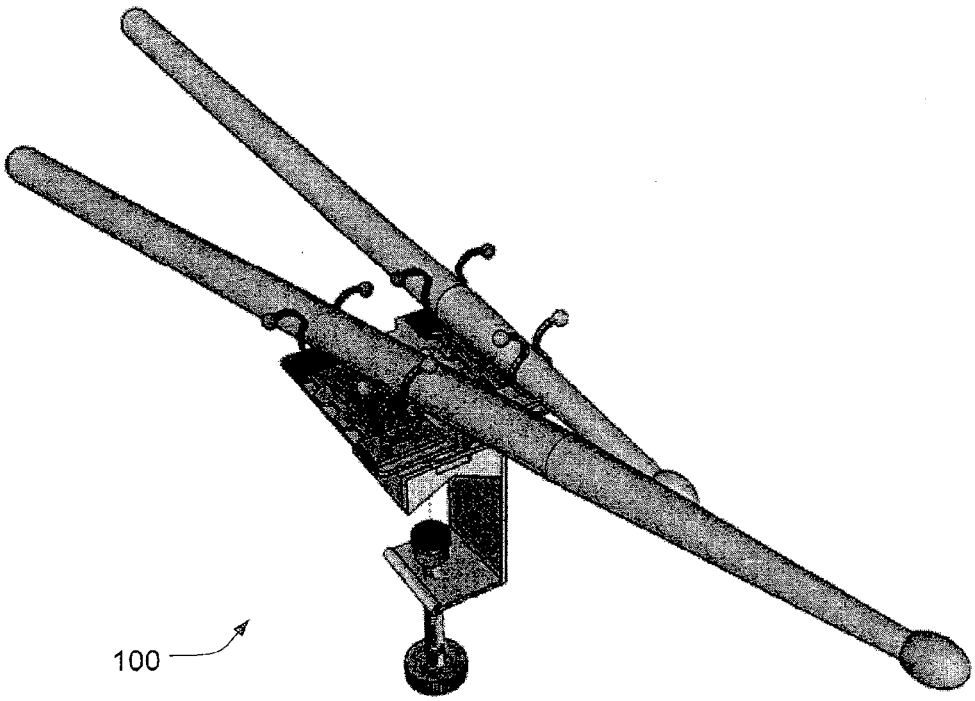
FIG. 18 is perspective view of the drum stick holder shown with drum sticks mounted in a third arrangement thereon according to an embodiment of the present invention.

Drum sticks can be held in drum stick holder in a number of configurations, as shown in FIGS. 16 through 18. Drum sticks can be snapped into clips 115 at the tip-end, butt-end, middle, or anywhere in between. Individual drum sticks in drum stick holder 100 can each be positioned differently and separately, without regard to how the other stick(s) in holder 100 is/are positioned.

Drum stick holder 100 accommodates a number of different stick sizes and styles and automatically adjusts to the sticks to create a firm, stable, and vibration resistant hold for sticks. These features when combined with the extremely versatile attachment system, lets drummers keep sticks ready in previously unusable yet highly desirable locations.

Figure 19:
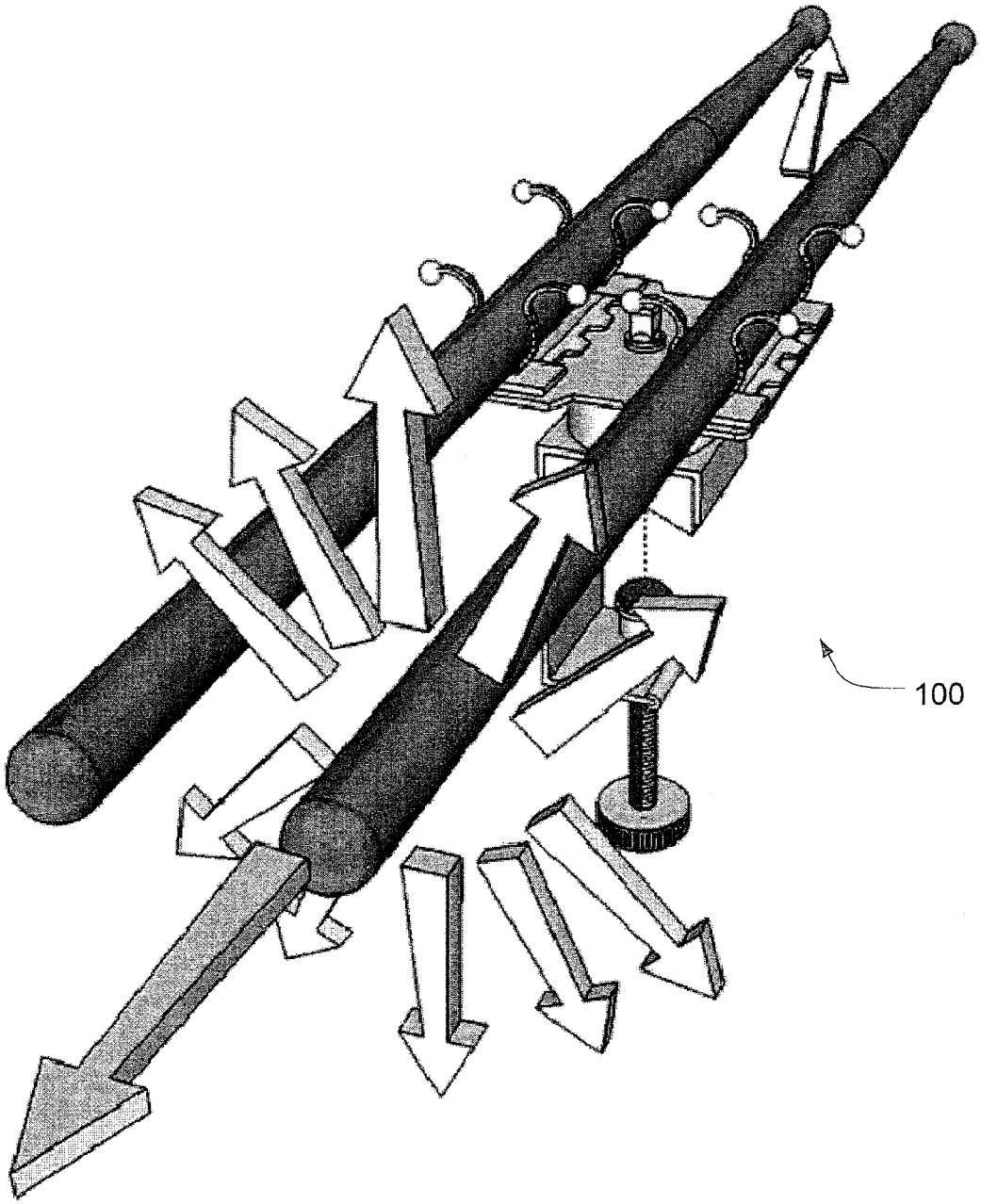
FIG. 19 is a perspective view of the drum stick holder shown with drum sticks mounted thereon and illustrating a number of directions that a drum stick may be moved in order to remove it from the drum stick holder according to an embodiment of the present invention.
Figure 20:
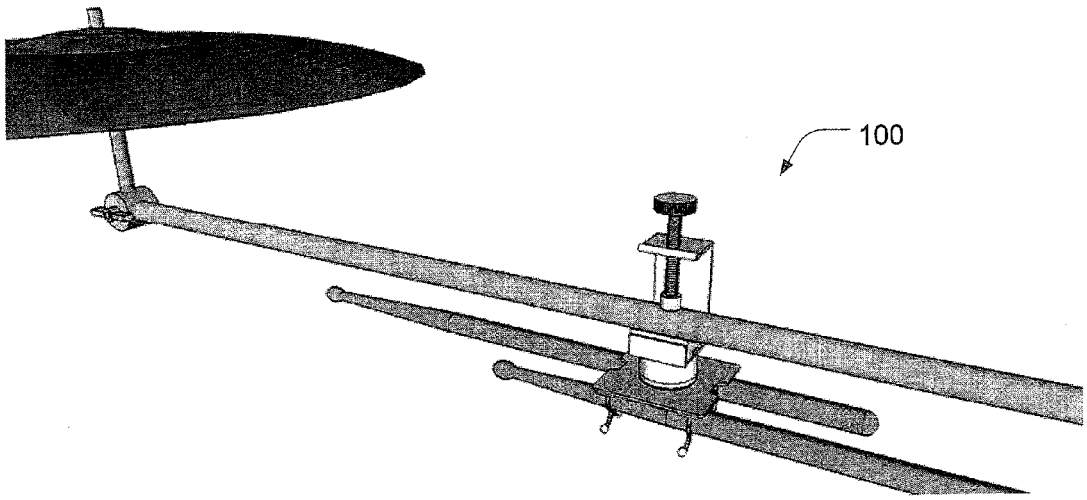
FIGS. 20 and 21 are perspective views of the drum stick holder shown mounted on the support rod of a percussion instrument according to an embodiment of the present invention.
Figure 21:
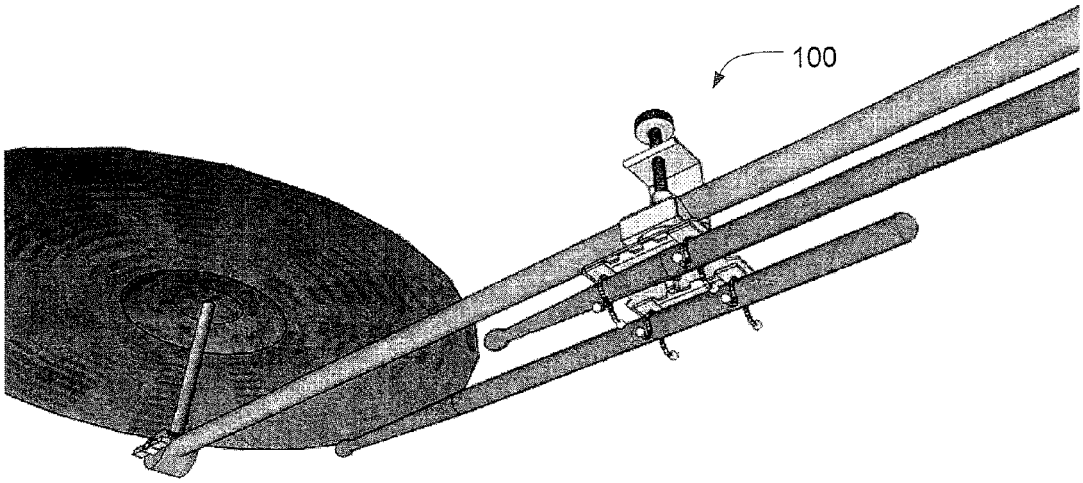
Figure 22:
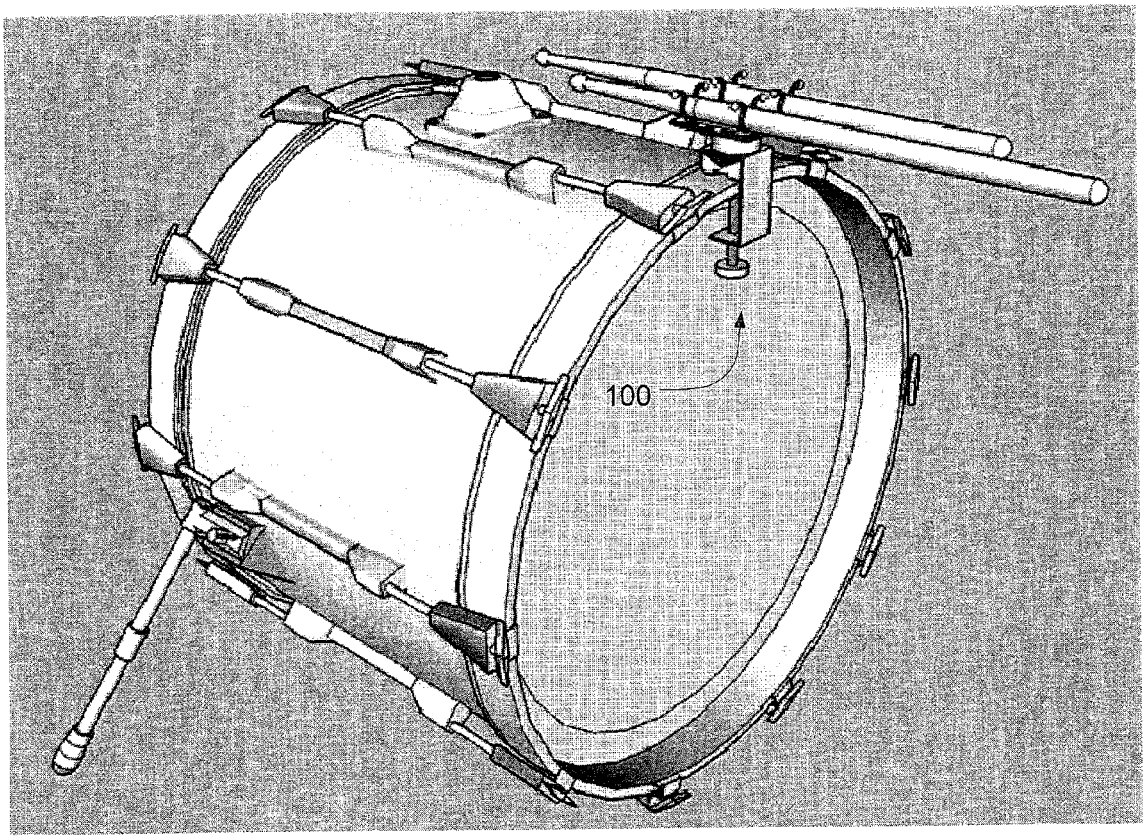
FIGS. 22 through 24 are perspective views of the drum stick holder shown mounted to the hoop of a bass drum according to an embodiment of the present invention.
Figure 23:
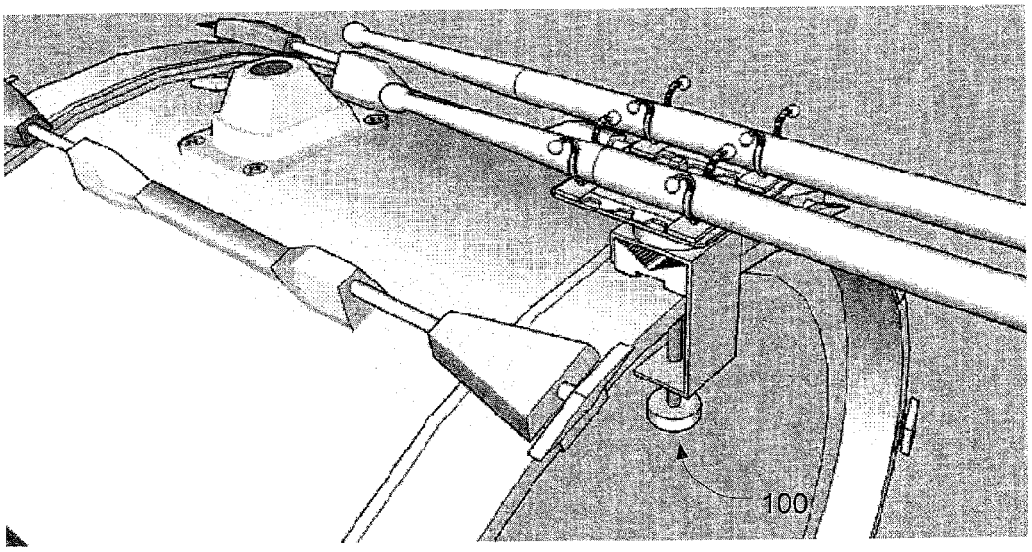
Figure 24:
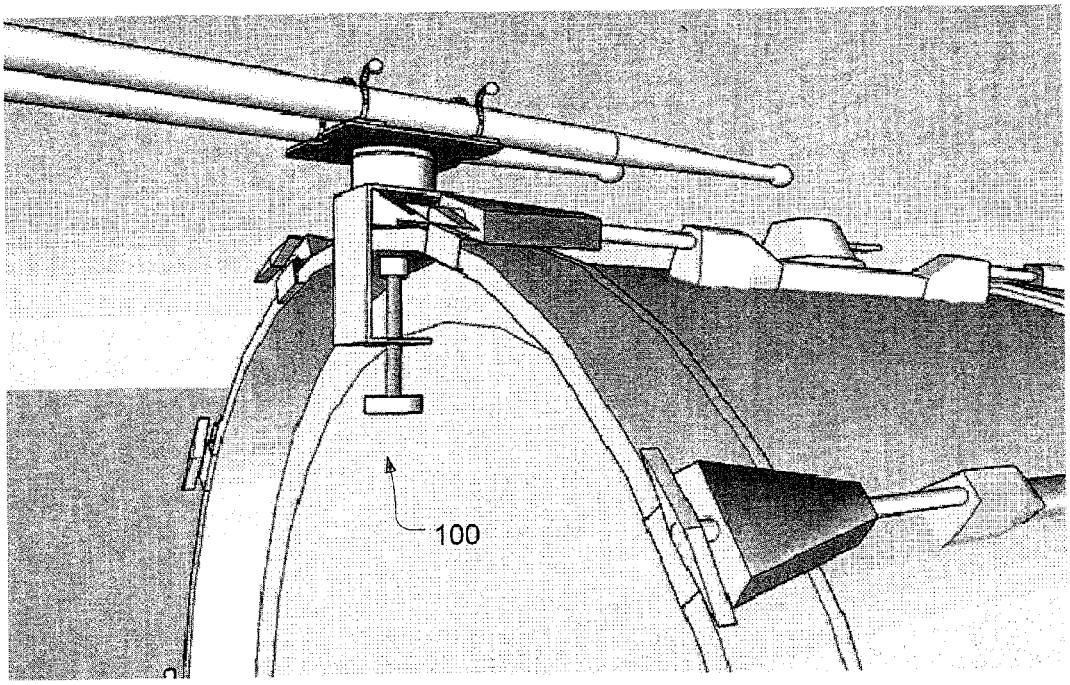
Figure 25:
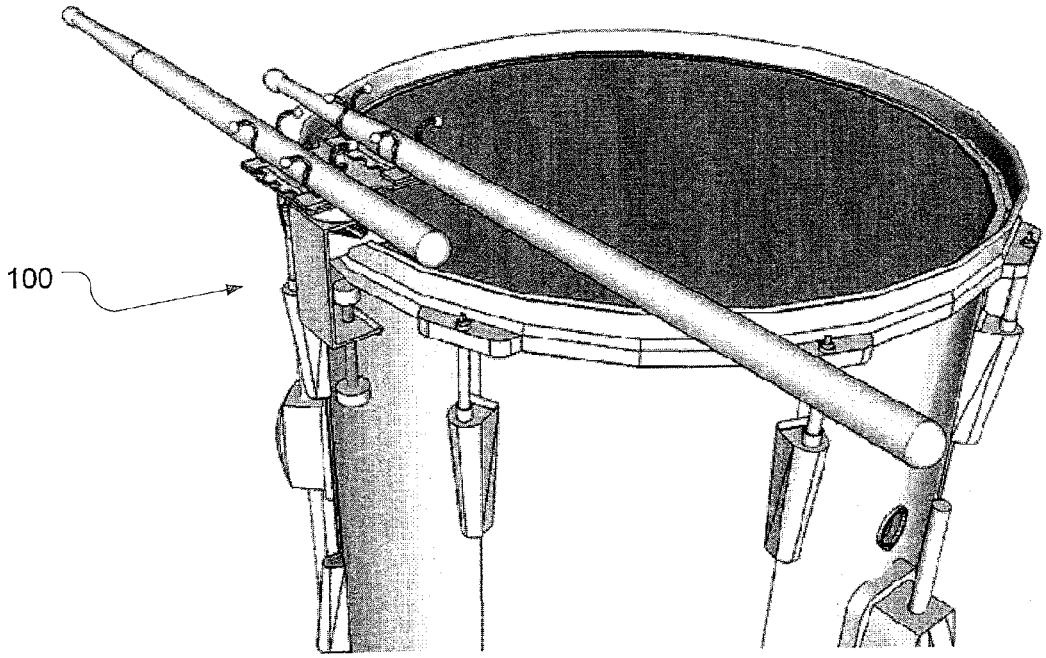
FIG. 25 is a perspective view of the drum stick holder shown mounted to the hoop of a percussion instrument, such as a snare or tom, according to an embodiment of the present invention.

Removing sticks, the most common use of a drum stick holder, can be done from a wide range of angles, as illustrated in FIG. 19. For example, a drum stick can be pulled out end-wise or can simply be grabbed from the side of the holder from many different angles. In addition, because drum stick holder 100 can function on its side, upside down, and at all points in between, all of the above angle options are exponentially multiplied. With such maneuverability, over one hundred different stick removal angles can be achieved.

One advantage of drum stick holder 100 is that it has a number of mounting options. For example, drum stick holder 100 can be placed on and around a drum kit, including hanging upside-down from a cymbal boom above a drummer's head, while maintaining complete functionality. Drum stick holder 100 can attach to the hoop of a percussion instrument instead of an individual tensioning rod. Thus, the weight of drum stick holder 100 is spread out and shared by all of the tensioning rods, not just one or two. Drum stick holder 100 may also be mounted in many other non-hoop and non-tensioning rod locations and can be adjusted, while sticks are in the holder, along four axes for increased and improved placement.

Drum stick holder 100 can be mounted to a number of surfaces as illustrated in FIGS. 20 through 25. For example, it attaches to drum stands, including snare, tom, floor-tom and roto-tom stands, drum hardware, cymbal stands, including hi-hat stands, crash and ride cymbal stands and boom arms, drum hoops (or drum rims) including snare, toms (or rack toms), floor-toms, roto-toms, bass drum hoops, floor tom legs, drum racks and cages (e.g. Gibraltar® brand racks), tom suspension mounts, percussion racks, workstations and tables, electronic drum pads (e.g. Roland® brand), drum thrones, including the center post, legs, and seat (the underside with simple adapter), drummer's arm or leg—with optional arm/leg strap (e.g. for marching band), microphone stands (incl. standard thin boom extensions), video game drum simulators' pads and pad holder racks, lighting equipment stands, trusses, booms, grids, leg braces on tripod stands (round or rectangular, including double braced legs), keyboard stand legs and supports including square and rectangular styles (sometimes used by drummers to hold electronic drum sound modules and other electronic percussion gear including computers), rack mount gear case edges, table tops, and various other locations.

Drum stick holder 100 has a modular design which allows for customization and personalization of the device. Parts of drum stick holder 100 that work together as a unit can be separated from the whole device and either the same or a different design of that modular unit may be added to replace it. Also, some modular units can function separately. Most notably, support member 105 and mounting bracket 110 can be used in other ways.

For example, the support member 105, middle portion (including spacer 130 and post 134), and mounting bracket 110 can each be individually swapped out for various elements. Additional adapters and brackets may be substituted while maintaining full functionality of the remaining elements.

Additional types of platforms can be attached to mounting bracket 110, either as substitutes or as supplements to support member 105. Such platforms could be decorative in nature and/or functional. In an embodiment, decorative platforms may be used together with the primary support member and may be attached between base plate 125 and spacer 130. Such decorative platforms may extend underneath and beyond base plate 125 to show visual appeal. Examples of such a decorative support member include colored trim, embellishments, and designs such as a skull, flames, animals, and mythical creatures. The decorative platforms may also be used without support member 105 in purely decorative ways where the rest of the holder, most notably mounting bracket 110, is used to place and position the decorative support member in visually interesting locations.

In an additional embodiment, functional platforms of various shapes and sizes can be attached to support member 105 or alternatively between base plate 125 and spacer 130. Functional types of platforms include adding extensions that hold more sticks, adding a drum key holder, drink holder, cooling fan, lighting device, or multipurpose hook. The forgoing types of platforms are meant to be illustrative and are not to be construed in a limiting sense.

As illustrated in FIGS. 26 and 27, support member 105 can be detached from mounting bracket 110 and, without modification, used as a wall-mounted display unit. This is useful for standard stick storage, collectible sticks displays, retail product displays, or trade show applications. Support member 105 can be mounted in a number of ways, including using center hole 132, using adhesive, and using known products for attaching posters to walls. For a model without center hole 132, a simple adapter that accepts the end of a nail, screw or simple picture hook (or other type of hook) that protrudes from the wall may be used.

When used as a retail product display, support member 105 can be attached to retail peg-board wall display areas and other retail displays. Support member 105 may also be used to hold two sticks linked together in retail packaging sleeves (also referred to as "match boxes") such that a single pair of clips 115 holds one of the two sticks that are linked together, thereby holding both sticks.

Support member 105 can be used as a stick carrier. By securing one or more platforms 105 into a carrying case, a stick carrier is created that holds sticks securely, while preventing damage and eliminating rattle. Alternatively, clips 115 may be secured directly (or with clip base 120) inside a carrying case.

Mounting bracket 110 can be exchanged for a modified bracket design. For example, a magnetic base, a smaller/ larger special purpose bracket/clamp/or clip, or a strap or band for an arm or leg attachment can serve as a modified bracket design. Special purpose adapters may be incorporated into or substituted for the main bracket 135 because support member 105 easily detaches from one clamp and can be moved to a variety of other adapter clamps. In one embodiment, an extra U-shaped (or C-shaped) clip can be mounted on the fourth side of mounting bracket 135*c* of the mounting bracket 110 for added functionality. The addition of this clip would not hinder the drum stick holding functionality of the device in any way. This clip could function as a drum tuning key holder.

In an embodiment, the mounting bracket 110 can be modified into a microphone holder for receiving a microphone holding clip. In this embodiment, the support member 105 would be removed from the mounting bracket 110. A standard microphone thread adapter (either a metal cylinder with European thread on the inside and U.S. thread on the outside or a metal cylinder with only a U.S. thread on the outside) is positioned over the post 134 and screwed thereon. A rubber grommet is placed down the center of the microphone thread adapter such that the grommet is positioned on top of the post with the center hole of the grommet aligned with the hole in the post 134. To complete the modification, the rotation adjustment fastener 133 is screwed onto the end of the post 134 and tightened onto the rubber grommet. Once tightened sufficiently, the grommet expands under pressure and pushes outwards against the inner wall of the microphone thread adapter thus holding the adapter in place. If threaded on the inside surface, the grooves of the thread assist in holding the adapter in place. Once in place, the microphone thread adapter can receive any of numerous standard microphone holder clips.

A flat metal arm can be added to the post to provide additional distance range to the microphone. This flat metal arm can have opposing ends with one end having an opening disposed therein through which the arm can attach to the post. Once the arm is attached to the post with the post protruding through the arm, a thumb nut having a threaded core is then screwed onto the post to secure the arm to the post. The opposing end of the arm can contain a microphone thread adapter which can receive any of numerous standard microphone holder clips.

Additional modifications can be made to drum stick holder 100 to increase functionality including the addition of pins or notches, or other similar means, to indicate predefined increments or favorite positions during adjustment of support member 105 or clip 115 position; the addition of a mechanism(s) for locking parts of drum stick holder 100 in place to prevent unwanted or accidental movement or adjustment; and the addition of a mechanism for height adjustment that is more finely graduated.

Drum stick holder 100 can be used as a drum head dampener. In this embodiment, drum stick holder 100 is attached to the hoop of a drum and slanted inward to the point that the (thinner) edge of the rubber "V" or the wider surface of the opposite side of bracket pad 140 makes contact with the drum head. The pressure, angle, and surface of contact can be adjusted to the user's specifications.

The present invention, in broad terms, is a repositionable support system for drum-related objects. The system comprises an upper assembly including a base plate adapted to removably receive drum related objects; a lower assembly including an attachment member adapted to removably couple the lower assembly to a recipient object; and an intermediate assembly separably coupling the upper and lower assemblies.

Figure 31:
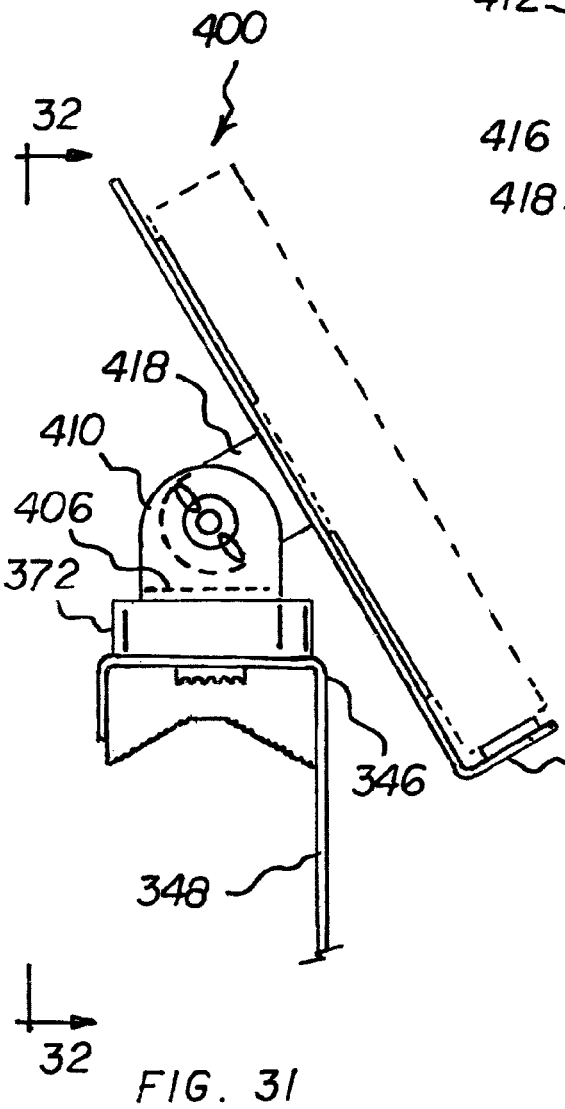
FIG. 31 is a side elevational view of the upper components of the system of FIGS. 28 and 29 but with the holder being for electronic devices and the like rather than for supporting drum sticks.
Figure 32:
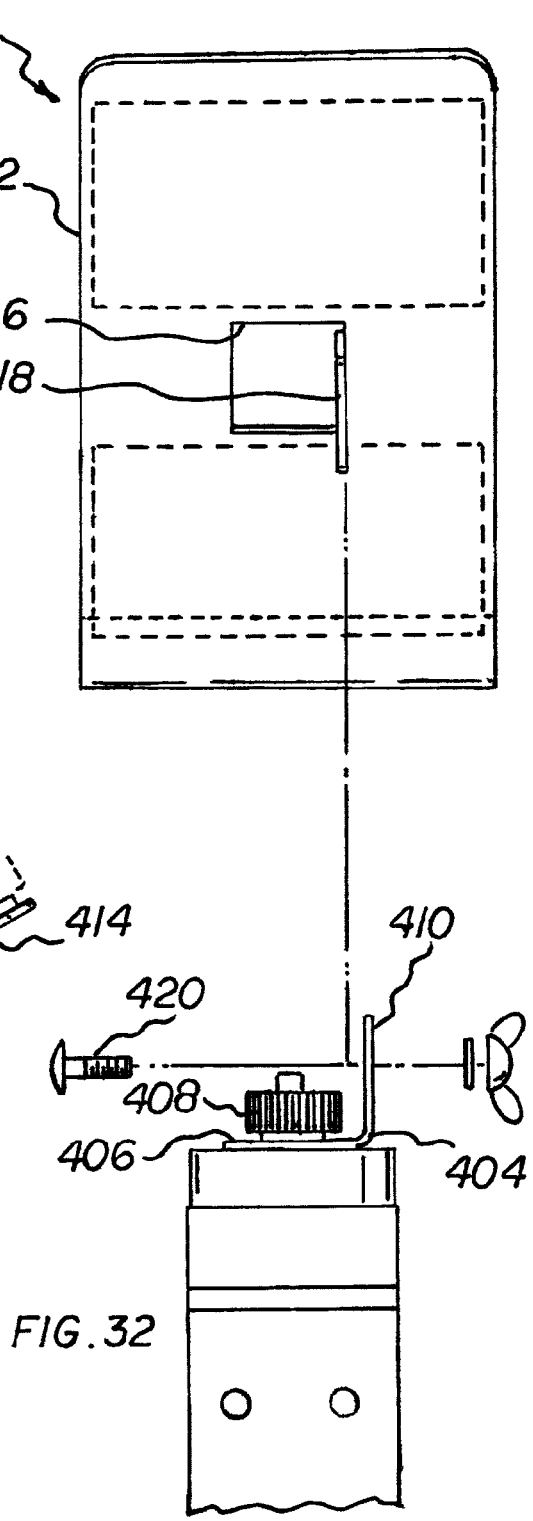
FIG. 32 is an exploded rear elevational view of the upper components of FIG. 31.

One embodiment is a system 400 as shown in FIGS. 31 and 32. The lower assembly 346 includes a lower bracket 348 in a C-shaped configuration below and a cylindrical spacer 372 above. The upper assembly includes an L-shaped bracket 404 with a horizontal leg 406 positioned upon the cylindrical spacer for constituting the base plate. The horizontal leg has a lower aperture. A bolt 408 extends through the lower aperture for constituting the intermediate assembly. The L-shaped bracket 404 has a vertical leg 410 with an upper aperture. The upper assembly also includes a tray 412 formed with a lower lip 414 adapted to hold electronic devices and the like. The tray has a rectangular aperture 416 for providing access to the intermediate member. The tray has a depending leg 418 with a pivot aperture. A threaded fastener 420 extends through the pivot aperture and the upper aperture for coupling the tray to the L-shaped bracket.

Figure 33:
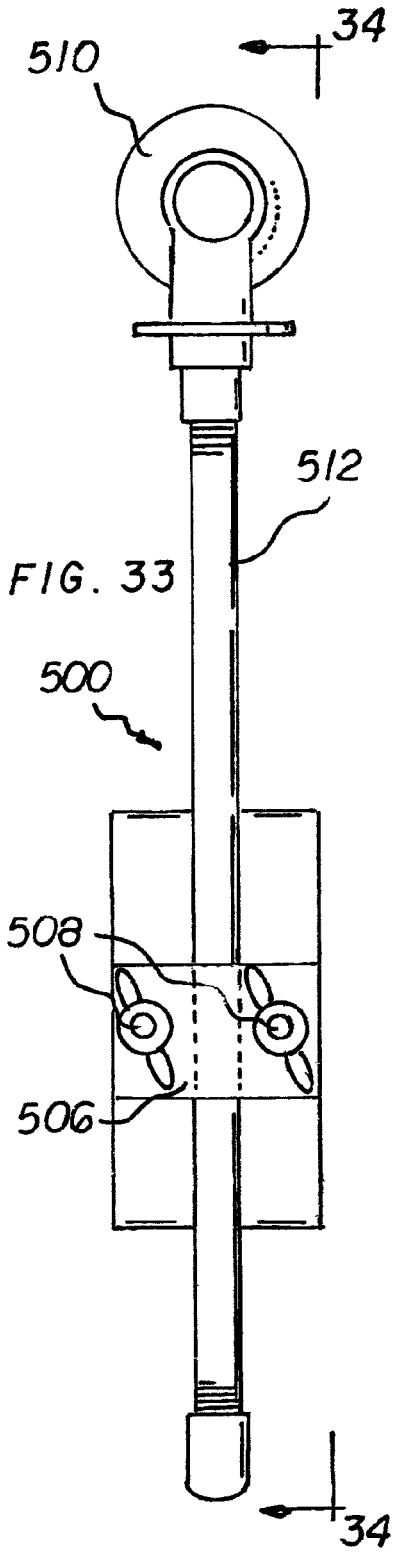
FIG. 33 is a rear elevational view of the upper components of the system of FIGS. 28 and 29 but with the holder being for a microphone.
Figure 34:
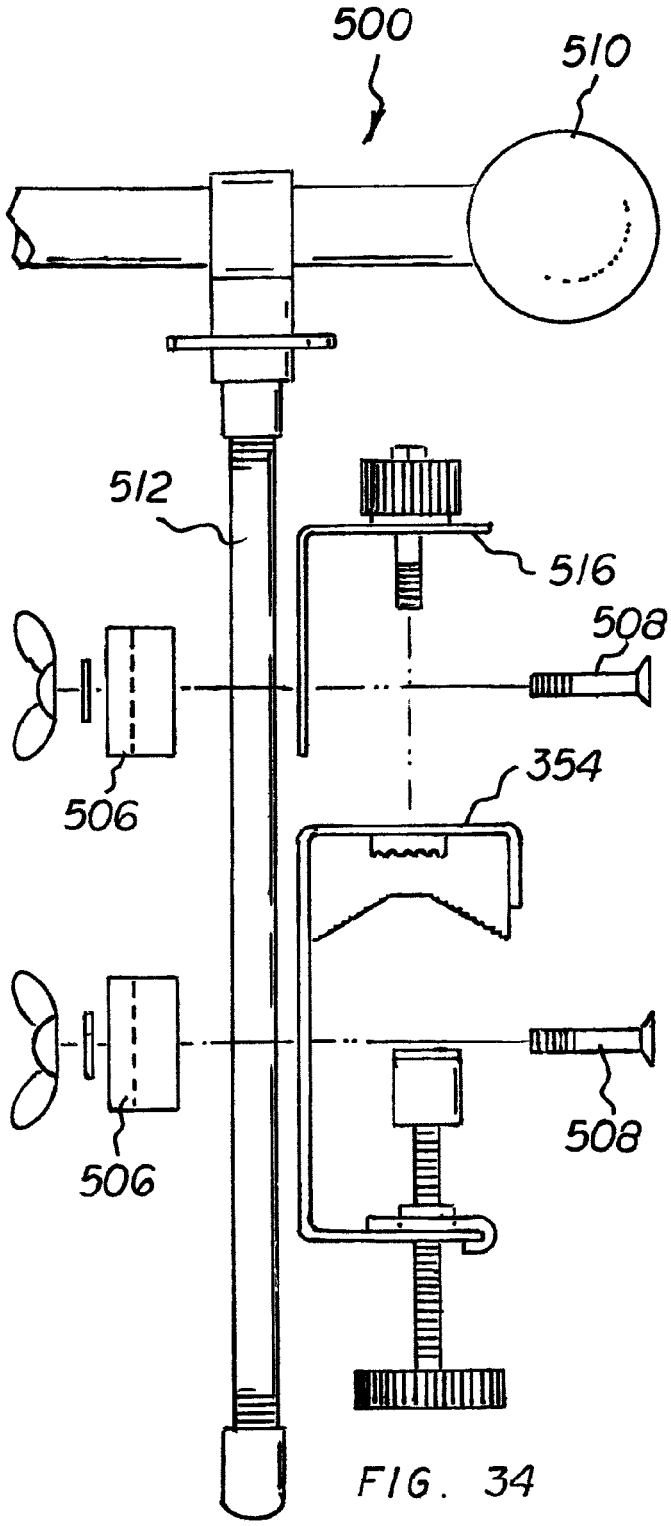
FIG. 34 is an exploded side elevational view of the upper components of FIG. 33 with alternate components for supporting a microphone.

A next embodiment is system 500 shown in FIGS. 33 and 34. In such embodiment, the lower assembly includes a lower bracket 348 in a C-shaped configuration with a long vertical leg 350 formed with two lower apertures. A pressure plate 506 is formed with two aligned apertures and a vertical recess between the aligned apertures of the pressure plate. Two threaded fasteners 508 extending through the two lower apertures and the two aligned apertures of the pressure plate. A microphone 510 with a vertical support rod 512 is next provided. The support rod is adjustably secured between the lower bracket and the pressure plate.

System 500 is illustrated in FIGS. 33 and 34. In this embodiment, the lower assembly includes a lower bracket 348 in a C-shaped configuration with an upper horizontal leg 354 formed with an upper aperture. An inverted L-shaped bracket 516 with an upper aperture overlies the upper aperture of the lower bracket. The L-shaped bracket 516 has a vertical leg with two laterally spaced alignment apertures. A pressure plate 506 is formed with two aligned apertures. Two threaded fasteners 508 extend through the two alignment apertures of the L-shaped bracket and the two aligned apertures of the pressure plate. A microphone 510 with a vertical support rod 512 is next provided. The support rod is adjustably secured between the L-shaped bracket and the pressure plate.

FIGS. 33 and 34 illustrate a further embodiment 500 which includes an inverted L-shaped bracket 516 with an upper aperture and two laterally spaced alignment apertures. A pressure plate 506 is formed with two aligned apertures. Two threaded fasteners 508 extend through the two alignment apertures of the inverted L-shaped bracket and the two aligned apertures of the pressure plate. Provided next is a microphone 510 with a vertical support rod 512. The support rod is adjustably secured between the L-shaped bracket and the pressure plate. An aperture is in a horizontal part of the inverted L-shaped bracket. The L-shaped bracket is adapted to attach directly to drum tension rods.

Figure 28:
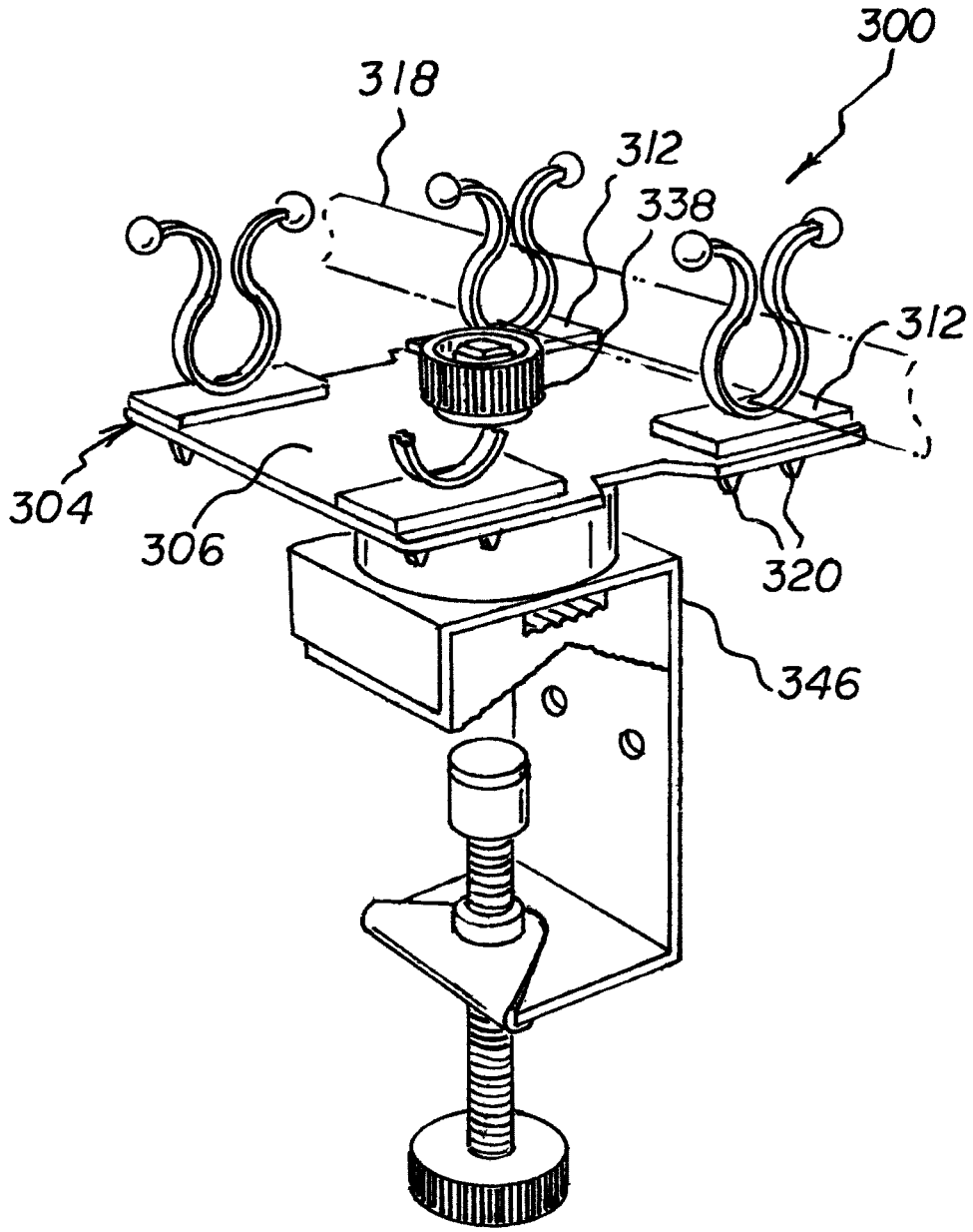
FIG. 28 is a perspective illustration of a repositionable support system constructed in accordance with the principles of the present invention.
Figure 29:
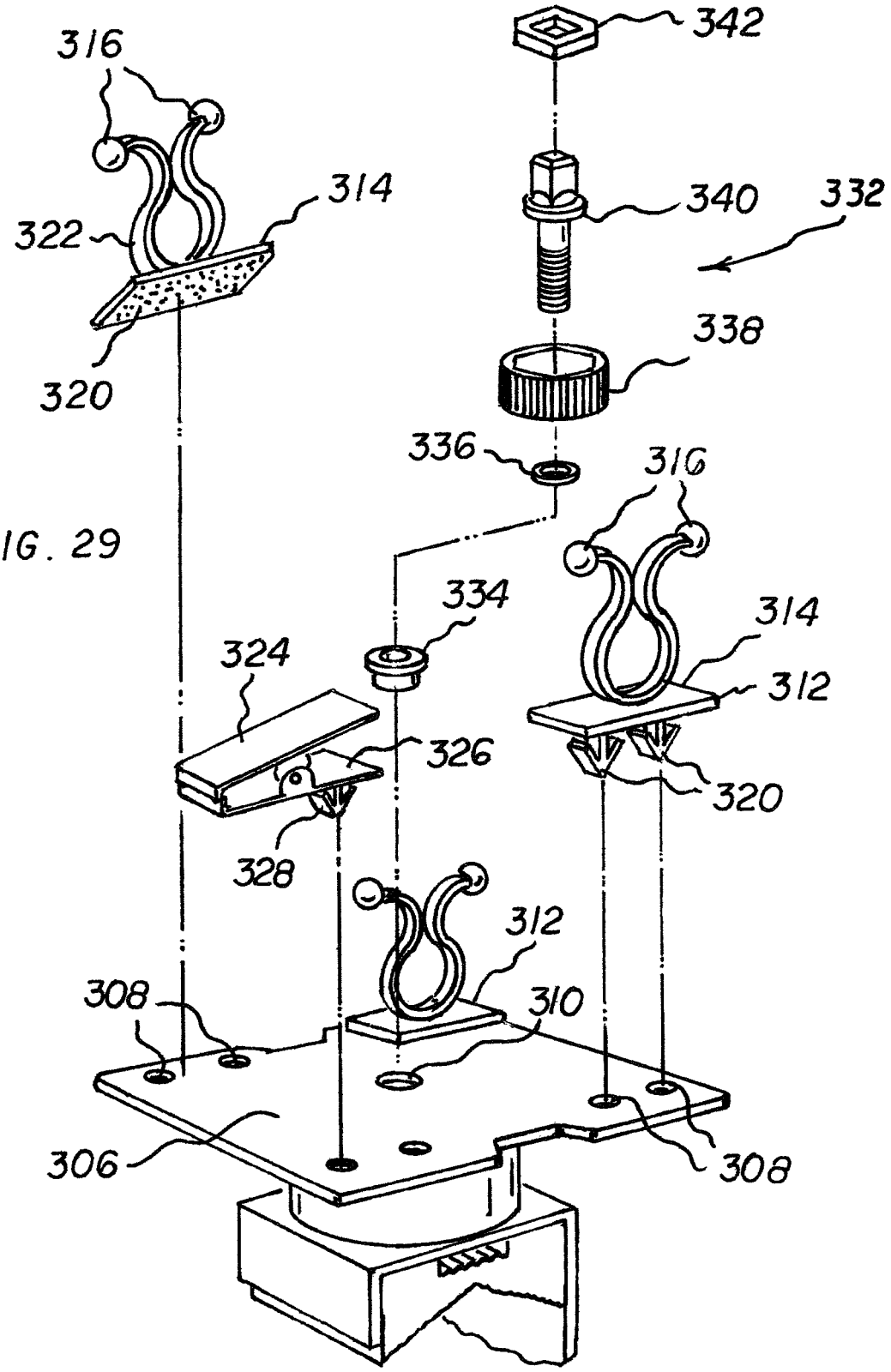
FIG. 29 is an exploded perspective illustration of the upper assembly of the system shown in FIG. 28.
Figure 30:
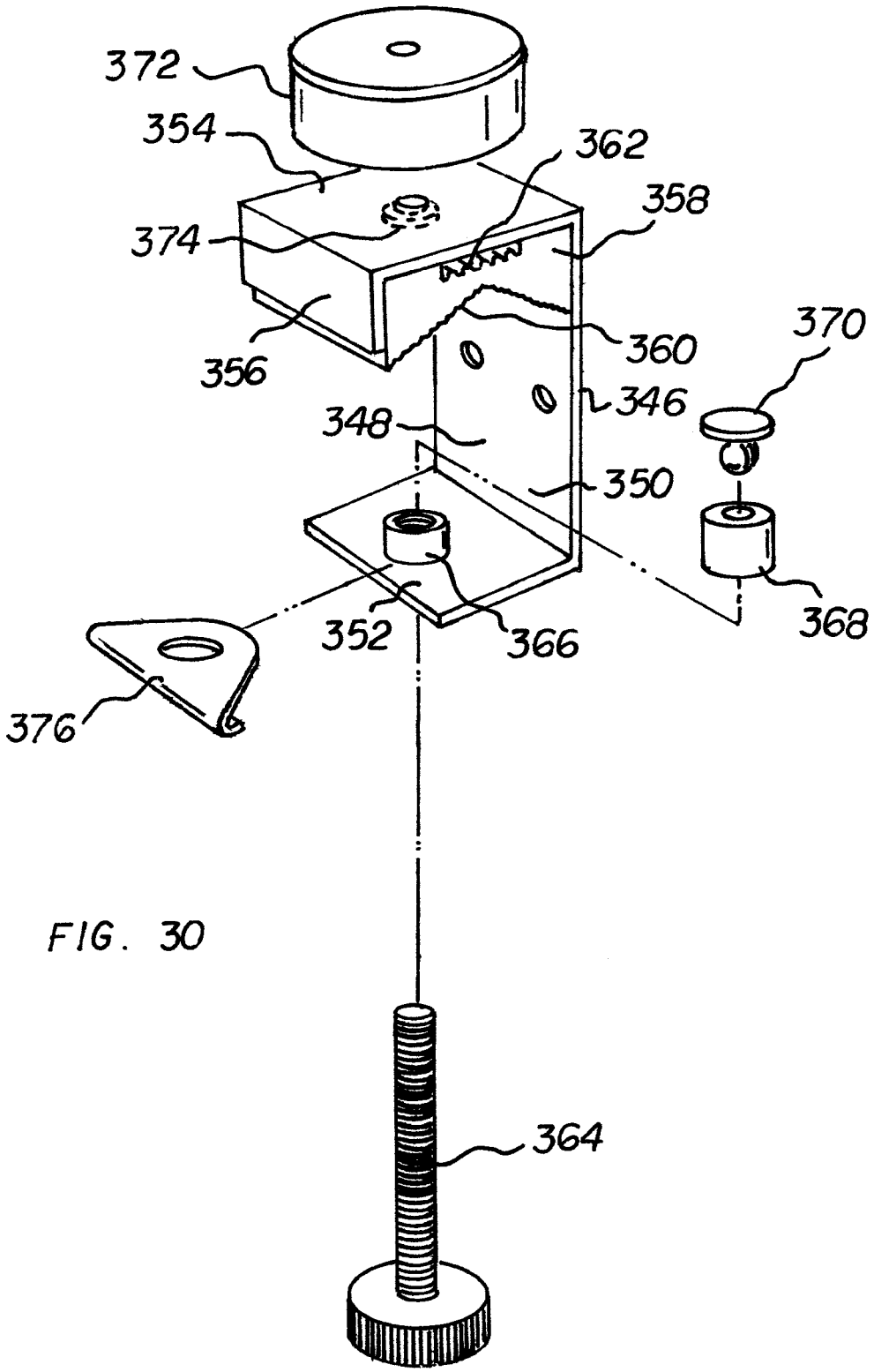
FIG. 30 is an exploded perspective illustration of the lower assembly of the system of FIGS. 28 and 29.

System 600 is the next embodiment shown in FIG. 35. In such embodiment, the lower assembly includes a lower bracket 348 in a C-shaped configuration with an upper horizontal leg 354 formed with an upper aperture. A J-shaped bracket 604 with an upper aperture overlies the upper aperture of the lower bracket. A threaded fastener 606 extends through the upper apertures of the lower bracket and the J-shaped bracket. Threaded fastener 606 of this embodiment corresponds to bolt 340 with thumb screw 338 and adapter 342 attached, as shown in FIGS. 28 and 29. C-shaped fingers 610 are coupled to the J-shaped bracket resiliently supporting a tuning key and the U-shaped fingers 614 are coupled to the J-shaped bracket resiliently supporting a cable.

The system 700 is an embodiment illustrated in FIG. 36. A lower assembly includes two laterally spaced tension rods 704. An arcuate strap 706 is formed with slots 708 facing the tension rods. A backing plate with spaced apertures is next provided. The tension rods are located between the backing plates and the arcuate strap. Threaded fasteners 712 extend through the spaced apertures and the slots. The arcuate strap has a central aperture 714 for removably receiving a base plate and the like.

The next embodiment, system 800, is shown in FIGS. 37, 38 and 39. In such embodiment, the upper assembly includes a geometric base plate with corner apertures 806 and an additional aperture 808. A threaded fastener 810 extends through the additional aperture 808 for coupling to a recipient object. The upper assembly also including four drum stick supports 814, 816. Each drum stick support has downwardly extending V-shaped fingers 820 for releasably coupling through the corner apertures. The drum stick supports include two tall supports 816 and two short supports 814 for allowing the drum sticks to cross when supported in the base plate. The entire base plate and the drum stick supports are adapted to be rotated to achieve different drum stick display configurations, horizontal, vertical, diagonal and crossed.

The primary and final embodiment is a repositionable support system 300 for drum-related objects. The repositionable support system is adapted to be removably attached to drums and other recipient devices. The drum related objects adapted to be removably supported include, but are not limited to, drum sticks, microphones, tuning keys, cables and electronic devices. The attaching and the supporting are done in a safe, convenient, tool-free and economical manner.

First provided is an upper assembly 304 including a base plate 306 in a geometric configuration with four corners and a center. Other configurations include rectangular, circular, Z-shaped and the like. A pair of corner apertures 308 extend through the base plate at each corner. A central aperture 310 extends through the base plate at the center. A plurality of primary drum stick clips 312 are next provided. Each primary drum stick clip has a central planar section 314. Each primary drum stick clip has upwardly extending resilient fingers 316 for removably supporting drum sticks 318. The resilient fingers are generally S-shaped for supporting drum sticks within the fingers and upon the fingers and with opposite ends within the resilient fingers and upon the resilient fingers. Each primary drum stick clip has two downwardly extending snap pins 320 with V-shaped fingers adapted to be compressed for movement into and out of the corner apertures for removably attaching the primary drum stick clips to the base plate. The resilient fingers of the snap pins provide for secure holding and anti-rotation. Next provided is a secondary drum stick clip 322. The secondary drum stick clip has a central planar section 314. The secondary drum stick clip has upwardly extending resilient fingers 316 for removably supporting drum sticks 318. The secondary drum stick clip has an adhesive 320 for attaching the secondary drum stick clip to the base plate. A tertiary sheet clip 324 is next provided. The tertiary sheet clip has a central planar section 326. The tertiary sheet clip also has an upper section pivotally coupled to the central planar section for removably supporting sheet material. The tertiary sheet clip also has a downwardly extending snap pin 328 with V-shaped fingers adapted to be compressed for movement into and out of the corner apertures for removably attaching to the base plate.

An intermediate assembly 332 includes a grommet 334 removably received in the center aperture. An upper washer 336 is positioned upon the grommet. A thumb screw 338 has a knurled exterior surface in a circular configuration and an interior surface in a hexagonal configuration. A bolt 340 has a square upper end and a threaded lower end extending through the thumb screw and washer and grommet. The bolt 340 of this embodiment with thumb screw 338 and adapter 342 attached corresponds to the threaded fastener 606 shown in FIG. 35. The intermediate assembly also includes an adapter 342 having a square interior in contact with the square upper end of the bolt and a hexagonal exterior in contact with the interior surface of the thumb screw.

Provided last is a lower assembly 346 which includes a lower bracket 348 in a C-shaped configuration. The lower bracket has a long leg 350 a short lower leg 352 and a short upper leg 354 with a down-turned lip 356. Two laterally spaced apertures are in the long leg and a lower aperture is in the lower leg. An upper aperture is in the upper leg. In addition, an elastomeric block 358 is positioned in the lower assembly between the long leg and the down-turned lip in contact with the short upper leg. The elastomeric block has a first face 360 with an undulating V-shaped configuration. The elastomeric block has a second face 362 with an undulating rectangular configuration. The elastomeric block is adapted to be repositioned in any of four orientations depending on the particular application. Flexing is adapted to be varied as a function of the orientation of the block for shock and vibration dampening and absorbing. The lower assembly includes a securement bolt 364 extending upwardly through the lower aperture. A securement nut 366 is attached to the lower aperture and threadedly receiving the securement bolt. The securement bolt has a free end with a threaded cover 368 and a snap-on cover 370, for rotatably reducing friction, movable toward and away from the elastomeric block in response to the rotation of the securement bolt to thereby couple and uncouple the system to a drum or other recipient object. The lower assembly includes a bumper 376 fabricated of an elastomer and covering a portion of the lower leg. The bumper has apertures receiving the securement bolt for coupling the bumper to the lower leg. The lower assembly includes a spacer 372 in a cylindrical configuration and fabricated of an elastomeric material positioned between the base plate and the upper leg. The lower assembly includes an intermediate nut 374 attached to the upper leg adjacent to the upper aperture for receiving the upper bolt to thereby couple together the upper and lower assemblies.

The inventive concept herein includes a means for performing functions which were formerly done with a tuning key, functions such as rotating, tightening, loosening, etc. The use herein of the thumb screw 338, together with the adapter 342, when attached to any bolt having a square upper end, eliminates the need for tuning keys, while still simultaneously preserving the choice of operation by means of a tuning key, and improves the operation of the present system as well as the operation of a wide variety of systems with square headed threaded fasteners so long as there is accessible space around the threaded fastener. In an additional embodiment, the grommet may be removed with the base plate positioned on cymbal stand. The need for the lower bracket is thus eliminated.

In the preceding specification, all documents, acts, or information disclosed does not constitute an admission that the document, act, or information of any combination thereof was publicly available, known to the public, part of the general knowledge in the art, or was known to be relevant to solve any problem at the time of priority.

The disclosures of all publications cited above are expressly incorporated herein by reference, each in its entirety, to the same extent as if each were incorporated by reference individually.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A repositionable support system for drum-related objects comprising:

an upper assembly including a horizontally oriented base plate in a geometric configuration with four corners and a center, an upper aperture through the center, at least one corner aperture adjacent to each corner, the base plate adapted to removably receive drum related objects;

a lower assembly including an attachment member adapted to removably couple the lower assembly to a recipient object, the lower assembly including an upper leg with a lower aperture, the lower assembly including a cylindrical spacer with a central aperture in axial alignment between the upper aperture and the lower aperture; and an intermediate assembly including a vertically oriented bolt extending through the upper aperture and the central aperture and the lower aperture separably coupling the upper and lower assemblies.

2. A repositionable support system (300) for drum-related objects, the repositionable support system adapted to be removably attached to drums and other recipient devices, the drum related objects adapted to be removably supported including, but not limited to, drum sticks, microphones, tuning keys, cables and electronic devices, the system comprising, in combination:

an upper assembly (304) including a base plate (306) in a geometric configuration with four corners and a center, a pair of corner apertures (308) through the base plate at each corner, a central aperture (310) through the base plate at the center, a plurality of primary drum stick clips (312), each primary drum stick clip having a central planar section (314), each primary drum stick clip having upwardly extending resilient fingers (316) and removably supporting drum sticks (318), the resilient fingers being generally S-shaped for supporting drum sticks within the fingers and upon the fingers and with ends within and upon the resilient fingers, each primary drum stick clip having two downwardly extending snap pins (320) with V-shaped fingers adapted to be compressed for movement into and out of the corner apertures for removably attaching the primary drum stick clips to the base plate, a secondary drum stick clip (322), the secondary drum stick clip having a central planar section (314), the secondary drum stick clip having upwardly extending resilient fingers (316) for removably supporting drum sticks (318), the secondary drum stick clip having an adhesive (320) for attaching the secondary drum stick clip to the base plate, a tertiary sheet clip (324), the tertiary sheet clip having a central planar section (326), the tertiary sheet clip having an upper section pivotally coupled to the central planar section for removably supporting sheet material, the tertiary sheet clip having a downwardly extending snap pin (328) with V-shaped fingers adapted to be compressed for movement into and out of the corner apertures for removably attaching to the base plate;

an intermediate assembly (332) including a grommet (334) removably received in the center aperture, an upper washer (336) positioned upon the grommet, a thumb screw (338) having a knurled exterior surface in a circular configuration and an interior surface in a hexagonal configuration, a bolt (340) having a square upper end and a threaded lower end extending through the thumb screw and washer and grommet, the intermediate assembly also including an adapter (342) having a square interior in contact with the square upper end of the bolt, the adapter having a hexagonal exterior in contact with the interior surface of the thumb screw;

a lower assembly (346) including a lower bracket (348) in a C-shaped configuration, the lower bracket having a long leg 350 a short lower leg (352) and a short upper leg (354) with a down-turned lip (356), two laterally spaced apertures in the long leg, a lower aperture in the lower leg, an upper aperture in the upper leg, an elastomeric block (358) positioned in the lower assembly between the long leg and the down-turned lip in contact with the short upper leg, the elastomeric block having a first face (360) with an undulating V-shaped configuration, the elastomeric block having a second face (362) with an undulating rectangular configuration, the lower assembly including a securement bolt (364) extending upwardly through the lower aperture, a securement nut (366) attached to the lower aperture and threadedly receiving the securement bolt, the securement bolt having a free end with a threaded cover (368) and a snap-on cover (370) movable toward and away from the elastomeric block in response to the rotation of the securement bolt to thereby couple and uncouple the system to a recipient object, the lower assembly including a bumper (376) fabricated of an elastomer and covering a portion of the lower leg, the bumper having apertures receiving the securement bolt for coupling the bumper to the lower leg, the lower assembly including a spacer (372) in a cylindrical configuration and fabricated of an elastomeric material positioned between the base plate and the upper leg, the lower assembly including an intermediate nut (374) attached to the upper leg adjacent to the upper aperture for receiving the upper bolt to thereby couple together the upper and lower assemblies.

* * * * *